US011752771B2

(12) United States Patent
Kiyokawa

(10) Patent No.: US 11,752,771 B2
(45) Date of Patent: Sep. 12, 2023

(54) DISCHARGE APPARATUS

(71) Applicant: CANON KABUSHIKI KAISHA, Tokyo (JP)

(72) Inventor: Yusuke Kiyokawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/375,552

(22) Filed: Jul. 14, 2021

(65) Prior Publication Data

US 2022/0016889 A1 Jan. 20, 2022

(30) Foreign Application Priority Data

Jul. 17, 2020 (JP) ..... 2020-123149

(51) Int. Cl.
*B41J 2/165* (2006.01)
*B41J 2/045* (2006.01)
*B41J 2/125* (2006.01)

(52) U.S. Cl.
CPC ..... *B41J 2/16579* (2013.01); *B41J 2/0451* (2013.01); *B41J 2/04561* (2013.01); *B41J 2/125* (2013.01)

(58) Field of Classification Search
CPC ..... B41J 2/04561
See application file for complete search history.

(56) References Cited

U.S. PATENT DOCUMENTS 9,676,182 B2 6/2017 Kiyokawa
2006/0139392 A1* 6/2006 Fernandez ..... B41J 2/125 347/19
2012/0139982 A1* 6/2012 Abe ..... B41J 2/2142 347/14

FOREIGN PATENT DOCUMENTS

JP 2007-152853 A 6/2007
JP 2010131800 A * 6/2010

OTHER PUBLICATIONS

Miyata, MachineTranslationofJP-2010131800-A, 2010 (Year: 2010).*

* cited by examiner

*Primary Examiner* — Scott A Richmond
(74) *Attorney, Agent, or Firm* — Venable LLP

(57) ABSTRACT

A discharge head includes an orifice surface in which orifices each configured to discharge a droplet are arrayed in a predetermined direction. A detecting unit includes a light emitting element and a light receiving element, and optically detects a droplet discharged from the orifice. A suppression unit is arranged between the light emitting element and the orifice surface, and suppresses the light emitted from the light emitting element from reaching the orifice surface by shielding at least some rays of the light which are emitted from the light emitting element and would otherwise propagate to the orifice surface.

13 Claims, 18 Drawing Sheets

DISCHARGE APPARATUS

BACKGROUND OF THE INVENTION

Field of the Invention

The present invention relates to a discharge apparatus.

Description of the Related Art

An inkjet printing apparatus prints an image by discharging ink droplets which are an example of droplets. However, as the inkjet printing apparatus is continuously used, the ink droplet discharge speed can sometimes change due to individual differences of the printing apparatuses and printheads, the physical properties of the ink, and the state of use of the printing apparatus or the environmental influence on the printing apparatus. If the ink droplet discharge speed changes, when an image is to be printed by reciprocally scanning the printhead, the relationship between the ink droplet landing positions of ink droplets discharged in a forward scan direction and the ink droplet landing positions of ink droplets discharged in a backward scan direction will shift. As a result, the image quality will be affected.

Japanese Patent Laid-Open No. 2007-152853 discloses a registration adjustment method in which a printhead includes an optical detector for measuring the discharge speed of the ink to be discharged, and a discharge timing is appropriately set according to the movement speed of the printhead and the ink discharge speed based on the measurement result. In addition, Japanese Patent Laid-Open No. 2007-152853 also discloses, as an ink discharge speed measurement method, a method in which the time it takes for discharged ink to reach a light beam emitted by the optical detector is measured and a discharge speed is calculated based on the measurement result and the distance from the printhead to the light beam.

SUMMARY OF THE INVENTION

According to one embodiment of the present invention, there is provided a discharge apparatus comprising: a discharge head that includes an orifice surface in which orifices each configured to discharge a droplet are arrayed in a predetermined direction; a detecting unit that includes a light emitting element configured to emit light and a light receiving element configured to receive light emitted from the light emitting element, and configured to optically detect a droplet discharged from the orifice in a state in which the orifice surface of the discharge head is present between the light emitting element and the light receiving element in a predetermined direction; and a suppression unit that is arranged between the light emitting element and the orifice surface, and configured to suppress light emitted from the light emitting element from reaching the orifice surface by shielding at least some rays of light which is emitted from the light emitting element and propagates to the orifice surface.

Further features of the present invention will become apparent from the following description of exemplary embodiments (with reference to the attached drawings).

DESCRIPTION OF THE EMBODIMENTS

Figure 1:
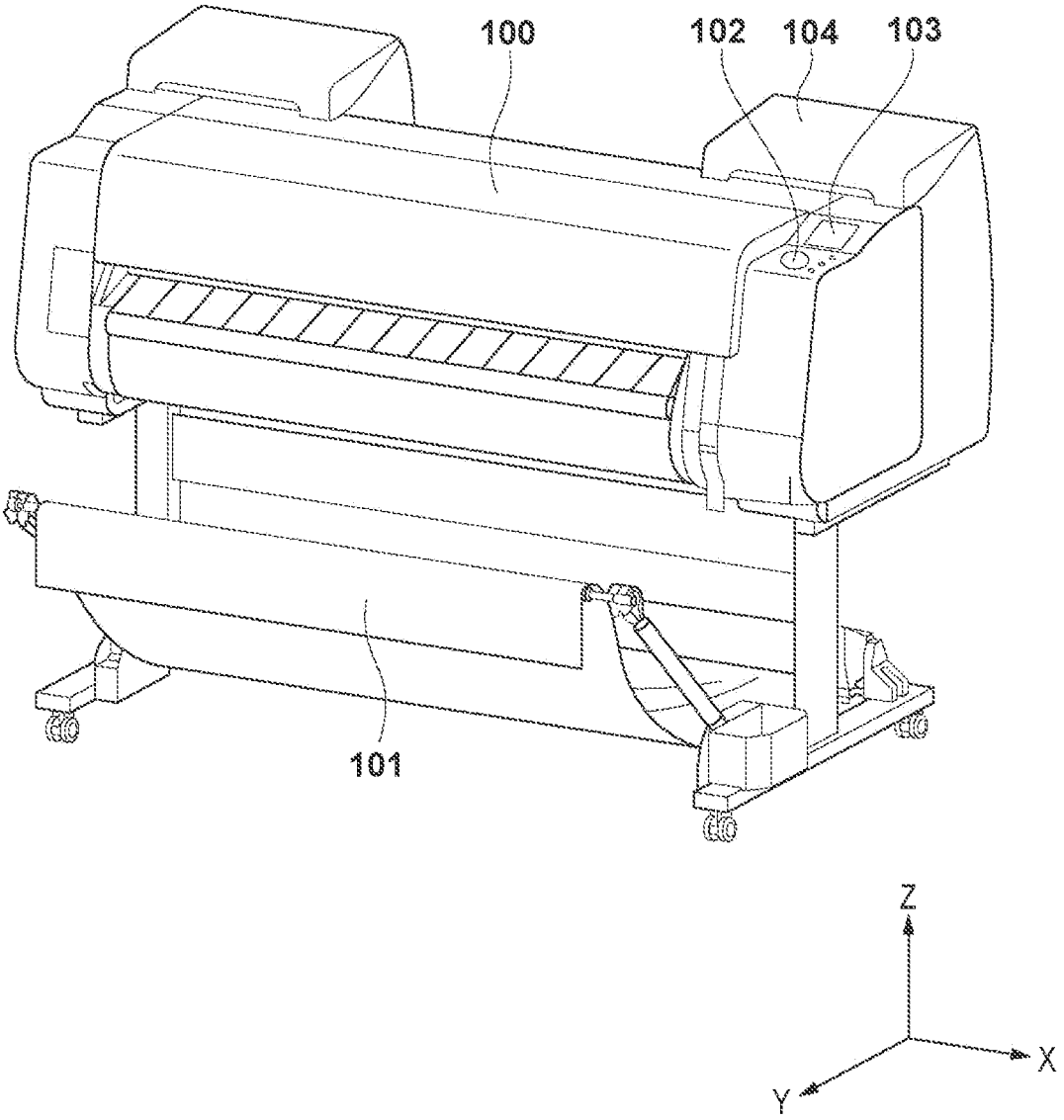
FIG. 1 is a view showing the outer appearance of a printing apparatus according the first embodiment.

When ink discharged by a printhead is to be detected, some of the rays of light emitted from a light emitting element may be reflected by the printhead and enter into a light receiving element. If the rays of light reflected by the printhead enter into the light receiving element, the measurement accuracy may degrade when time it takes for the ink discharged from the printhead to reach a light beam emitted by an optical detector is measured. If the measurement accuracy degrades, it may influence the accuracy of specifying an ink droplet discharge speed which is obtained based on the time it takes for the ink to reach the light beam.

Embodiments of the present invention provide a technique that improves the accuracy of specifying a droplet discharge speed.

Hereinafter, embodiments will be described in detail with reference to the attached drawings. Note, the following embodiments are not intended to limit the scope of the claimed invention. Multiple features are described in the embodiments, but limitation is not made to an invention that requires all such features, and multiple such features may be combined as appropriate. Furthermore, in the attached drawings, the same reference numerals are given to the same or similar configurations, and redundant description thereof is omitted.

Note that in this specification, the term "printing" (to be also referred to as "print" hereinafter) not only includes the formation of significant information such as characters and graphics, regardless of whether they are significant or insignificant. Furthermore, it broadly includes the formation of images, figures, patterns, and the like on a print medium, or the processing of the medium, regardless of whether they are so visualized as to be visually perceivable by humans.

In addition, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to also be referred to as a "liquid" hereinafter) should be extensively interpreted similarly to the definition of "printing (print)" described above. That is, "ink" includes a liquid which, when applied onto a print medium, can form images, figures, patterns, and the like, can process the print medium, or can process ink (for example, solidify or insolubilize a coloring material contained in ink applied to the print medium).

Further, a "nozzle" generically means an orifice or a liquid channel communicating with it, and an element for generating energy used to discharge ink, unless otherwise specified.

First Embodiment

<Overall Outline of Printing Apparatus>

FIG. 1 is a view showing the outer appearance of an inkjet printing apparatus (to be referred to as a printing apparatus hereinafter) 100 as an example of a droplet discharge apparatus according to an embodiment.

The printing apparatus 100 shown in FIG. 1 includes a sheet discharge guide 101 for stacking output print media, a display panel 103 for displaying various kinds of printing information, setting results, and the like, and an operation button 102 for setting a printing mode, print sheet settings, and the like. In addition, the printing apparatus 100 includes an ink tank unit 104 that accommodates ink tanks containing inks of colors such as black, cyan, magenta, yellow, and the like and supplies the inks to a printhead 201 (FIG. 2), which is an example of a droplet discharge head. The printing apparatus of FIG. 1 is a printing apparatus that can print on print media of a plurality of widths and of a size up to 60 inches. A rolled sheet or a cut sheet can be used as a print medium 203. Furthermore, the print medium 203 is not limited to paper and may be, for example, cloth or vinyl.

Figure 2:
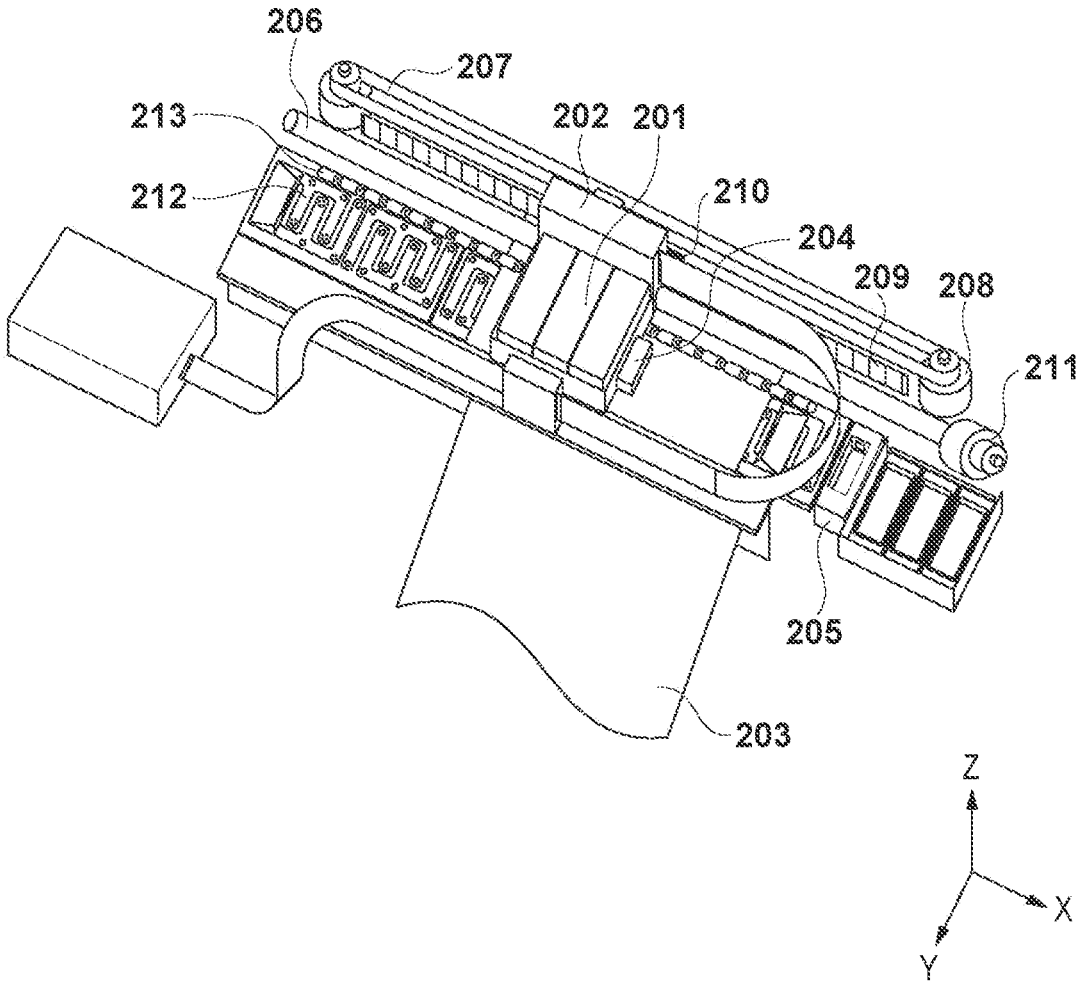
FIG. 2 is a perspective view showing the internal arrangement of a printing apparatus according to the first embodiment.

FIG. 2 is a perspective view showing the internal arrangement of the printing apparatus 100. A platen 212 is a member for supporting the print medium 203 positioned in a position that faces the printhead 201. The print medium 203 is conveyed, while being supported by the platen 212, by sheet conveyance rollers 213 in a conveyance direction (Y direction).

The printhead 201 discharges ink to print an image on the print medium 203. The printhead 201 includes an orifice surface 201*a* (FIG. 5A) on which orifices for discharging ink droplets are arrayed in a predetermined direction. In this embodiment, in the orifice surface 201*a*, an orifice array in which a plurality of orifices are arrayed in the Y direction is formed for each ink color, and the orifice arrays are arrayed in the X direction. The printhead 201 prints an image on the print medium 203 by discharging ink to the print medium 203 while being reciprocally moved by a carriage 202.

The printhead 201 also includes a distance detecting sensor 204 for detecting the distance between the printhead 201 and the print medium 203 on the platen 212. The distance detecting sensor 204 includes a light emitting unit 702 (FIG. 8A) that emits light onto the print medium 203 and light receiving units 703 and 704 (FIG. 8A) that receive light reflected from the print medium 203. The distance detecting sensor 204 measures the distance between the printhead 201 and the print medium 203 based on the changes in the outputs of the received light amounts of the light receiving units 703 and 704. A more specific example will be given later with reference to FIG. 8A.

A droplet detecting unit 205 is a sensor for detecting droplets, that is, ink droplets in this case, discharged from the printhead. The droplet detecting unit 205 is an optical sensor that includes a light emitting element 401 (FIG. 5A), a light receiving element 402 (FIG. 5A), a control circuit substrate 403 (FIG. 5A), and a housing 2051 (5A) for accommodating these components. A more specific example will be given later with reference to FIG. 5A.

A main rail 206 supports the carriage 202. The carriage 202 performs reciprocal scanning along the main rail 206 in the X direction (a direction perpendicular to the conveyance direction of the print medium). The scanning by the carriage 202 is performed by driving a carriage motor 208 via a carriage conveyance belt 207. A linear scale 209 is arranged in the scanning direction, and an encoder sensor 210 mounted in the carriage 202 obtains position information by detecting the linear scale 209. In addition, the printing apparatus 100 includes a lift cam (not shown) for changing, in a stepwise manner, the height of the main rail 206 that supports the carriage 202, and a lift motor 211 that drives this lift cam. By driving the lift cam by the lift motor 211, it will be possible to make the printhead 201 move up and down as well as increase/decrease the distance between the printhead 201 and the print medium 203. The printing apparatus 100 according to this embodiment can change the height of the printhead to multiple levels with a predetermined accuracy based on the stop position of the lift cam. Since the amount of change of this height is driven relatively with respect to the height of a predetermined level, a distance corresponding to the change between the levels can be set accurately.

Figure 3:
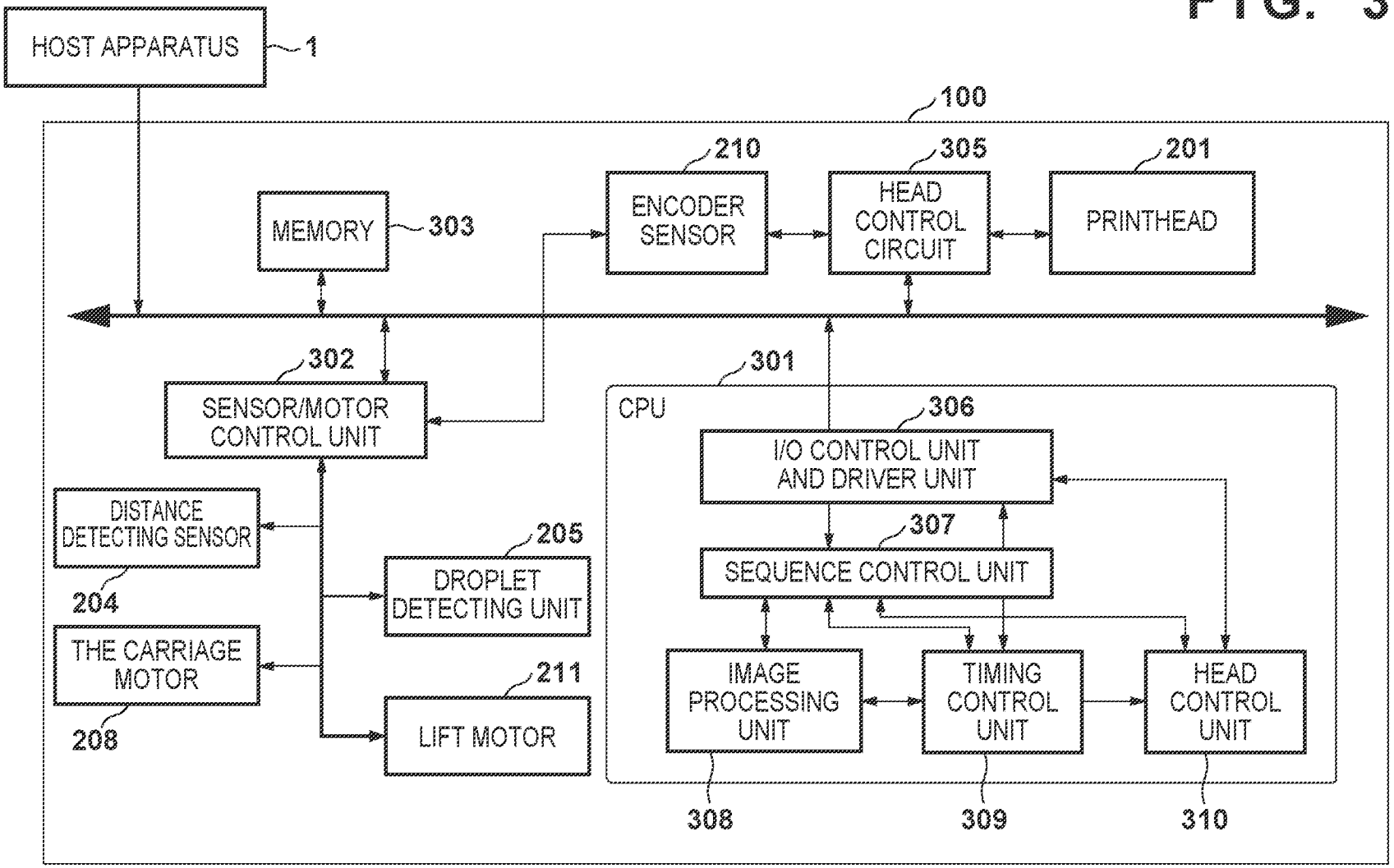
FIG. 3 is a block diagram showing the control arrangement of the printing apparatus according to the first embodiment.

FIG. 3 is a block diagram showing a control arrangement of the printing apparatus 100. The printing apparatus 100 includes a CPU 301 for controlling the entire apparatus, a sensor/motor control unit 302 for controlling the sensors and motors, and a memory 303 for storing various kinds of information such as the discharge speed, the thickness of the print medium, and the like. The CPU 301, the sensor/motor control unit 302, and the memory 303 are communicably connected to each other. The sensor/motor control unit 302 controls the distance detecting sensor 204, the droplet detecting unit 205, and the carriage motor 208 for scanning the carriage 202. The sensor/motor control unit 302 also controls a head control circuit 305 based on the position information detected by the encoder sensor 210 and causes the printhead 201 to discharge the ink.

Image data transmitted from a host apparatus 1 is converted into a discharge signal by the CPU 301, and printing is performed by discharging the ink from the printhead 201 to a print medium 203 in accordance with the discharge signal. The CPU 301 is formed by including a I/O control unit and driver unit 306 (to be referred to as the driver unit 306 hereinafter), a sequence control unit 307, an image processing unit 308, a timing control unit 309, and a head control unit 310. The sequence control unit 307 controls the general printing control operations and controls, more specifically, the activation and suspension of the image processing unit 308, the timing control unit 309, and the head control unit 310 as the respective functional blocks, controls the conveyance of a print medium, controls the scanning of the carriage 202, and the like. The control of the functional blocks is executed by causing the sequence control unit 307 to read out various kinds of programs from the memory 303 and execute the programs. The driver unit 306 generates, based on an instruction from the sequence control unit 307, control signals to the sensor/motor control unit 302, the memory 303, the head control circuit 305, and the like, and transmits input signals from the blocks to the sequence control unit 307.

The image processing unit 308 performs image processing by performing color separation/conversion on the image data input from the host apparatus 1 to convert the data into print data that is printable by the printhead 201. The timing control unit 309 transfers, in synchronization with the position of the carriage 202, the print data converted/generated by the image processing unit 308 to the head control unit 310. The timing control unit 309 also controls the ink discharge timing based on the print data. The timing control unit 309 controls this timing in accordance with the discharge timing that is determined based on a discharge speed calculated by discharge speed calculation processing which is to be described later. The head control unit 310 functions as a discharge signal generation unit by converting the print data input from the timing control unit 309 into a discharge signal and outputting the discharge signal. In addition, the head control unit 310 controls the temperature of the printhead 201 by outputting, based on an instruction from the sequence control unit 307, a control signal which will not cause the ink to be discharged. The head control circuit 305 functions as a driving pulse generation unit, and generates a driving pulse in accordance with the discharge signal input from the head control unit 310 and applies the driving pulse to the printhead 201.

Figure 4A:
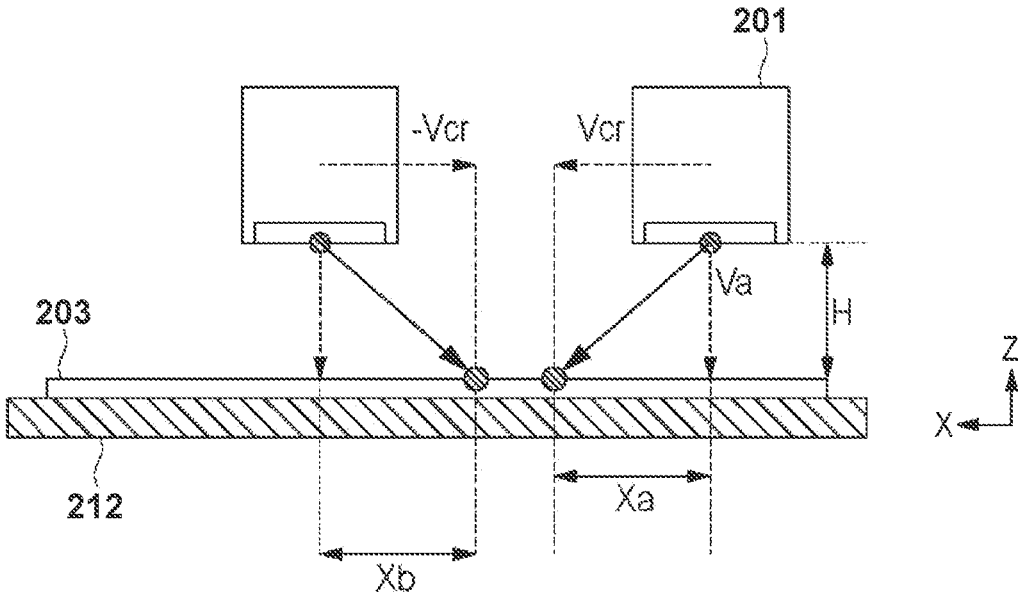
FIG. 4A is a schematic view showing the correlation between a discharge speed and a landing position of an ink droplet.

The discharge timing adjustment will be described next with reference to FIGS. 4A and 4B. FIG. 4A is a schematic view showing a relationship between the discharge speed of ink droplets and the landing position of each ink droplet. Let H be a distance between the orifice surface 201*a* of the printhead 201 and the print medium 203 in the Z direction. The printhead 201 prints an image on the print medium 203 by discharging ink while performing a reciprocal scanning operation at a speed Vcr in the X direction. Assume that Va is the size of a Z-directional component of the discharge speed of ink droplets discharged from the printhead 201. Note that in the following description, the size of the Z-directional component of the discharge speed of ink droplets may also be referred to as the discharge speed Va. As shown in FIG. 4A, since the printhead 201 will discharge ink while traveling in different directions in the scanning in the forward direction and in the scanning in the backward direction, the ink landing positions will differ from the ink droplet discharge positions. In this embodiment, the ink droplet discharge timing will be adjusted to make the landing positions of the ink droplets discharged from the printhead 201 match. First, a distance Xa, in the X direction, from an ink droplet discharge position to an ink droplet landing position on the print medium 203 during a scanning operation in the forward direction is calculated as follows.

$$Xa=(H/Va)\times Vcr \tag{1}$$

Furthermore, a distance Xb, in the X direction, from an ink droplet discharge position to an ink droplet landing position on the print medium 203 during a scanning operation in the backward direction is calculated as follows.

$$\begin{aligned} Xb &= (H/Va)\times -Vcr \\ &= -Xa \end{aligned} \tag{2}$$

By using the above equations, an appropriate discharge timing with respect to a position in the X direction of the printhead 201 detected by the encoder sensor 210 can be obtained. In this embodiment, the default discharge speed Va and the discharge timing with respect to the default discharge speed Va are stored in advance in the memory 303. An adjustment value of the discharge timing with respect to this default discharge speed Va is set as 0, and the adjustment value is adjusted between −4 to +4 in accordance with the discharge speed. The adjustment is performed at 1,200 dpi. A table in which the adjustment values of the discharge timing and the discharge speeds have been associated with each other is stored in advance in the memory 303. Subsequently, an adjustment value of the discharge timing corresponding to the speed obtained by the discharge speed calculation processing of FIG. 7 (to be described later) is obtained from the table, and the discharge timing is adjusted.

Figure 4B:
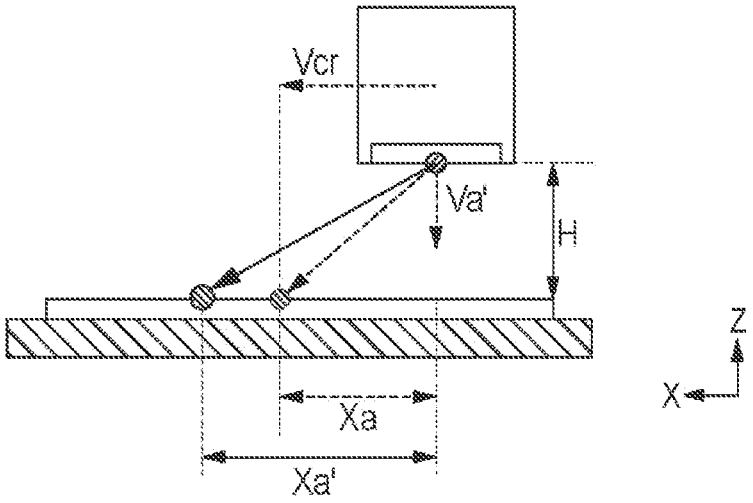
FIG. 4B is a schematic view showing the correlation between the discharge speed and the landing position of the ink droplet.

In addition, FIG. 4B shows a case in which the ink droplet discharge speed detected by the droplet detecting unit 205 has decreased from the discharge speed Va of the ink droplet shown in FIG. 4A to a discharge speed Va'. At this time, a distance Xa' from an ink droplet discharge position to an ink droplet landing position on the print medium 203 during a scanning operation in the forward direction is calculated as follows.

$$Xa'=(H/Va')\times Vcr \quad (3)$$

If it is assumed that the discharge speed Va' of the ink droplet until the ink droplet discharged from the printhead 201 lands on the print medium 203 has attenuated by 10% from the discharge speed Va, the distance from the discharge position to the landing position in the X direction can be obtained as follows.

$$\begin{aligned} Xa' &= (H/Va')\times Vcr \quad (4) \\ &= (H/(Va\times 0.9))\times Vcr \\ &= 1.11\times Xa \end{aligned}$$

As described above, when the discharge speed decreases, the landing position will shift in the scanning direction of the printhead 201. In this manner, even in a case in which the landing position has already shifted, an appropriate discharge timing adjustment value can be obtained based on the discharge speed, in a manner similar to FIG. 4A, as long as the distance from the discharge position to the landing position can be obtained. Note that in this embodiment, it can be assumed that the print medium 203 is sufficiently thin, and the distance between the orifice surface 201*a* of the printhead 201 and the print medium 203 is similar to the distance between the orifice surface 201*a* and the platen 212.

The method of calculating the discharge speed of ink droplets to be discharged from the printhead 201 according to this embodiment will be described next with reference to FIGS. 5A to 5D. FIGS. 5A to 5D are schematic views each showing the printhead 201 and the droplet detecting unit 205 when the printing apparatus 100 is cut along a section Y-Z. In addition, timing charts of a discharge signal for applying a driving pulse to the printhead 201 and a detection signal obtained when the droplet detecting unit 205 detects the passage of an ink droplet are shown. Note that illustration of components similar to those shown in FIG. 5A has been omitted in FIGS. 5B to 5D.

Figure 5A:
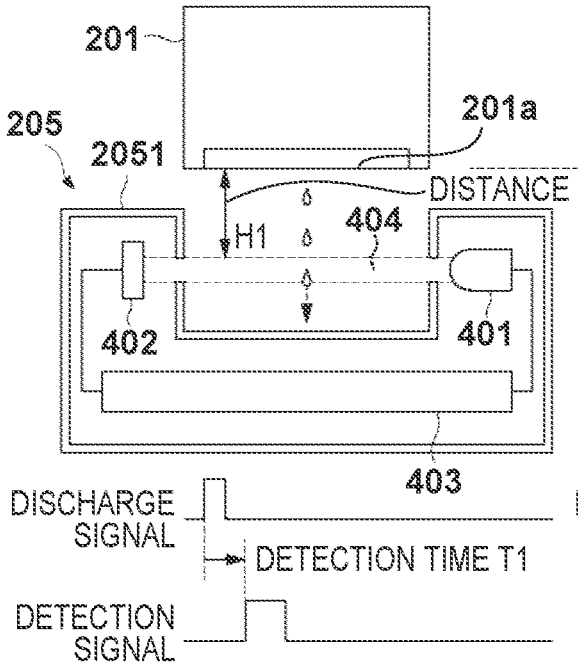
FIG. 5A is a view for explaining a method of calculating an ink droplet discharge speed according to the first embodiment.

As shown in FIG. 5A, the printhead 201 includes the orifice surface 201*a*. The droplet detecting unit 205 is formed by the light emitting element 401, the light receiving element 402, the control circuit substrate 403, and the like. The light emitting element 401 emits light 404, and the light receiving element 402 receives the light 404 emitted from the light emitting element 401. The light emitting element 401 and the light receiving element 402 are arranged at identical positions in the X direction, and an optical axis of the light 404 emitted from the light emitting element 401 is emitted so as to be parallel to the arrangement direction (Y direction) of the orifice arrays. The control circuit substrate 403 detects the amount of light received by the light receiving element 402. Since the received light amount will decrease when an ink droplet passes the light 404, the passage of the ink droplet can be detected based on this decrease in the received light amount. The droplet detecting unit 205 is installed so that the optical axis of the light 404 will be at a position identical to a surface, of the platen 212, which is on the side that supports the print medium 203 in the Z direction. A slit is provided near each of the light emitting element 401 and the light receiving element 402, and an S/N ratio is improved by focusing the entering light 404. The position of the printhead 201, in the X direction, which can discharge an ink droplet so that the ink droplet will pass through the light 404 will be set as a detectable position. When an ink droplet is to be detected to calculate the ink droplet discharge speed, the sequence control unit 307 will cause the sensor/motor control unit 302 to control the carriage motor 208, and the printhead 201 will move to the detectable position. Assume that the cross-sectional area of the beam of the light 404 according to this embodiment is approximately 1 (mm^2). Assume that the parallel projection area of an ink droplet when the ink droplet has passed the light 404 is approximately 2^-3 (mm^2).

FIG. 5A shows a state in which H1 is a distance, in the height direction (Z direction), between the orifice surface 201*a* of the printhead 201 and the light 404 emitted from the light emitting element 401. In a case in which the distance between the orifice surface 201*a* and the light 404 is not H1, the sensor/motor control unit 302 will drive the lift motor 211 to use the lift cam to change the height of the printhead 201. When the state has changed to the state shown in FIG. 5A, a discharge signal is transmitted from the head control unit 310 in the CPU 301 to the head control circuit 305 via the driver unit 306. The driver unit 306 transmits the transmission timing of the discharge signal to the sequence control unit 307. The head control circuit 305 generates a driving pulse in accordance with the discharge signal, and applies the driving pulse to the printhead 201 to cause the printhead to discharge ink from the orifices. When the amount of light received by the light receiving element 402 changes due to an ink droplet passing the light 404 emitted from the light emitting element 401, the timing at which the received light amount changed is output as the detection signal from the control circuit substrate 403. The output detection signal is transmitted to the sequence control unit 307 via the sensor/motor control unit 302. Subsequently, the sequence control unit 307 detects a detection time T1 which is a time from the transmission of the discharge signal to the output of the detection signal. As described above, the sequence control unit 307 functions as a time detection unit that detects the time from the start of ink discharge to the time until a discharged ink droplet is detected, and detects the detection time to be used for calculating the discharge speed.

Figure 5B:
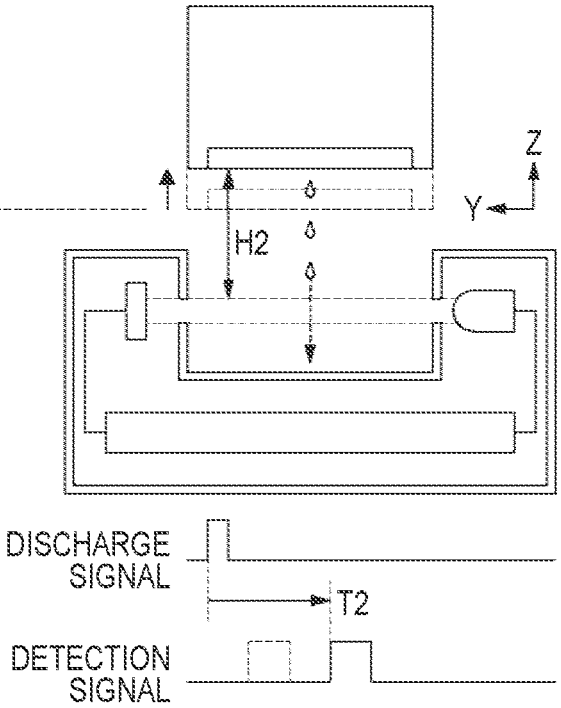
FIG. 5B is a view for explaining the method of calculating the ink droplet discharge speed according to the first embodiment.

FIG. 5B shows a state in which the lift motor 211 has been driven after an ink droplet has been detected in FIG. 5A, and H2 has been set as a distance, in the height direction (Z direction), between the orifice surface 201*a* of the printhead 201 and the light 404 emitted from the light emitting element 401. In a manner similar to FIG. 5A, the timing at which the received light amount of the light receiving element 402 changed when an ink droplet has passed the light 404 of the droplet detecting unit 205 will be output as the detection signal. Subsequently, a detection time T2 which is the time from the transmission of the discharge signal for causing the printhead 201 to discharge an ink droplet until the detection signal is output will be detected by the sequence control unit 307.

When the detection time T1 and the detection time T2 have been detected in the states of FIG. 5A and FIG. 5B, respectively, the sequence control unit 307 will calculate, based on a time difference between the detection time T1 and the detection time T2 and a distance difference between the distance H1 and the distance H2, a discharge speed V1 of an ink droplet that passes between the distance H2 and the distance H1. The calculation is as follows.

$$V1=(H2-H1)/(T2-T1) \quad (5)$$

Figure 5C:
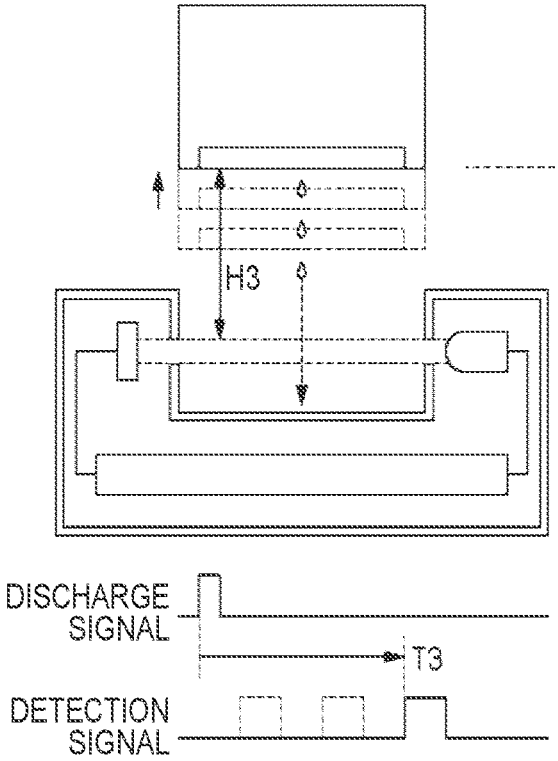
FIG. 5C is a view for explaining the method of calculating the ink droplet discharge speed according to the first embodiment.

After the discharge speed V1 has been calculated, the sensor/motor control unit 302 will drive the lift motor 211 to further increase the distance, in the height direction, between the orifice surface 201*a* and the light 404 from the distance H2 to a distance H3. This state is shown in FIG. 5C. In a manner similar to FIGS. 5A and 5B, an ink droplet will be discharged from an orifice of the printhead 201, and the timing at which the light amount changed when the ink droplet has passed the light 404 of the droplet detecting unit 205 will be detected as a detection signal by the control circuit substrate 403. Subsequently, a detection time T3 which is the time from the transmission of the discharge signal for causing the printhead 201 to discharge the ink droplet until the output of the detection signal is detected by the sequence control unit 307. In a manner similar to the descriptions of FIGS. 5A and 5B, a discharge speed V2 of the ink droplet that passes between the distance H3 and the distance H2 is calculated based on a difference between the detection time T2 and the detection time T3 detected for the distance H2 and the distance H3, respectively, and a distance difference between the distance H2 and the distance H3. The calculation is as follows.

$$V2=(H3-H2)/(T3-T2) \quad (6)$$

Figure 5D:
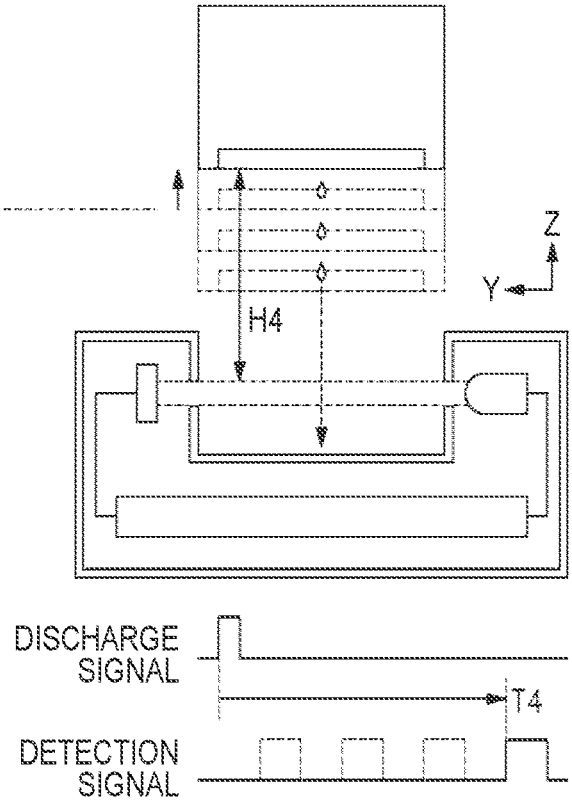
FIG. 5D is a view for explaining the method of calculating the ink droplet discharge speed according to the first embodiment.

After the calculation of the discharge speed V2, the sensor/motor control unit 302 will further drive the lift motor 211 to further increase the distance, in the height direction, between the orifice surface 201*a* and the light 404 from the distance H3 to a distance H4. This state is shown in FIG. 5D. In a manner similar to FIGS. 5A, 5B, and 5C, an ink droplet is discharged from an orifice of the printhead 201, the timing at which the light amount changed when the discharged ink droplet passed the light 404 of the droplet detecting unit 205 is detected as a detection signal by the control circuit substrate 403, and the detection signal is output. Subsequently, a detection time T4 which is the time from the transmission of the discharge signal for causing the printhead 201 to discharge an ink droplet to the output of the detection signal is detected by the sequence control unit 307. In a manner similar to the descriptions of FIGS. 5A and 5C, a discharge speed V3 of the ink droplet that passes between the distance H4 and the distance H3 is calculated based on a difference between the detection time T3 and the detection time T4 detected for the distance H3 and the distance H4, respectively, and a distance difference between the distance H3 and the distance H4. The calculation is as follows.

$$V3=(H4-H3)/(T4-T3) \quad (7)$$

As described above, the distance between the printhead 201 and the droplet detecting unit 205 is changed, and the detection time at each distance is detected to calculate a discharge speed V (the discharge speeds V1 to V3 in the example described above) of an ink droplet. Although the detection time is detected sequentially from a shorter distance in the above described example, the detection order is not limited to this. For example, the detection time may be detected sequentially from a longer distance. Note that in this embodiment, the separation distance H is a distance between 1.2 mm to 2.2 mm.

In addition, the discharge speed may be calculated by measuring the detection time at many more distances with respect to the distance between the printhead 201 and the droplet detecting unit 205. Since a discharge speed that corresponds to many distances can be calculated, it will be possible to obtain the attenuation influence of the discharge speed (whether the discharge remains constant or changes depending on the distance). As a result, it will be possible to obtain the discharge speed and the attenuation influence of the ink droplet more accurately.

Figure 6A:
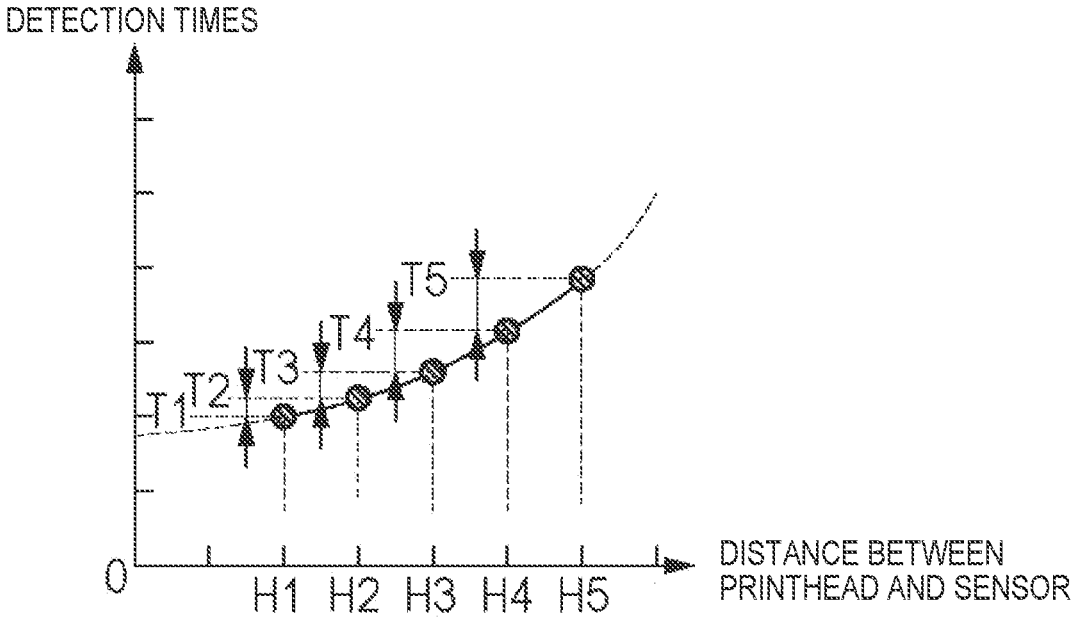
FIG. 6A is a graph showing detection times according to the first embodiment.
Figure 6B:
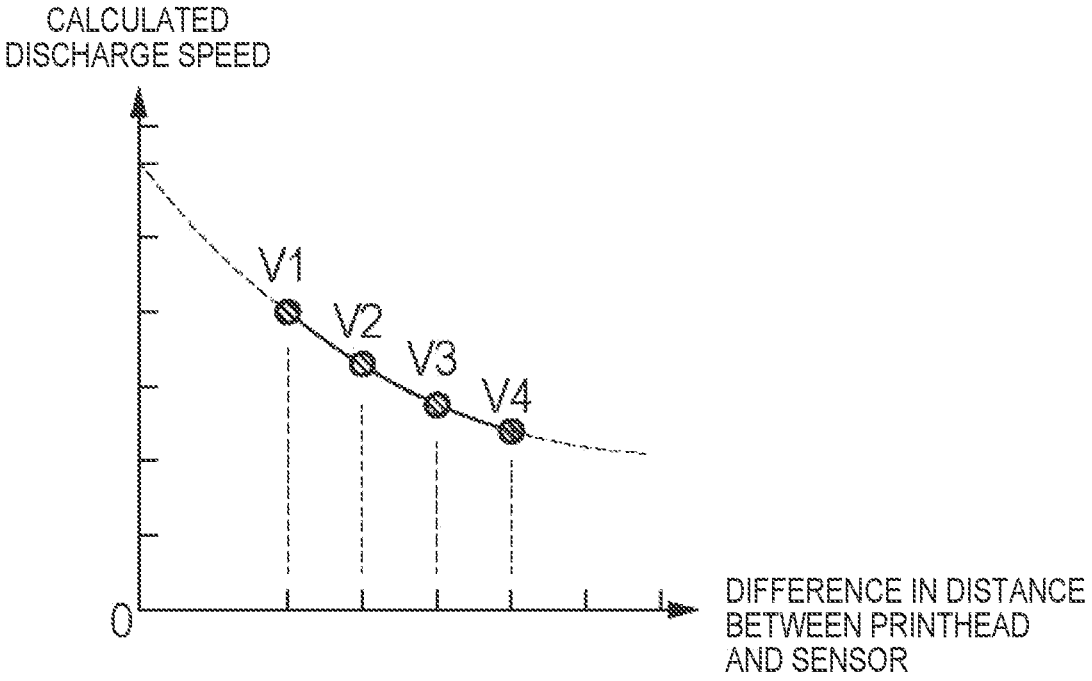
FIG. 6B is a graph showing the discharge speeds according to the first embodiment.
Figure 6C:
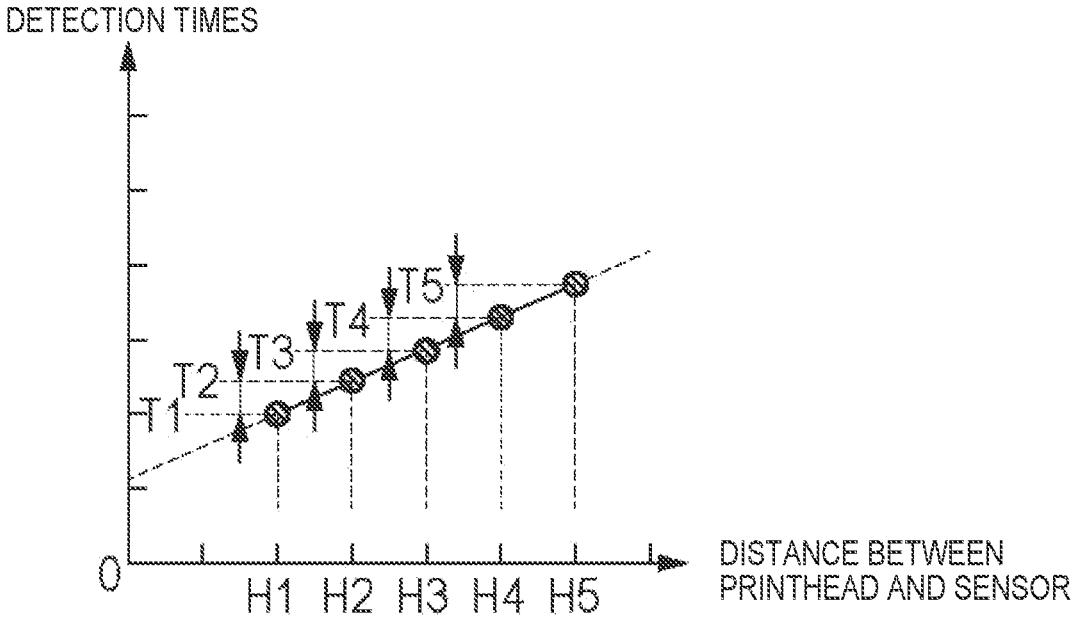
FIG. 6C is a graph showing the detection times according to the first embodiment.
Figure 6D:
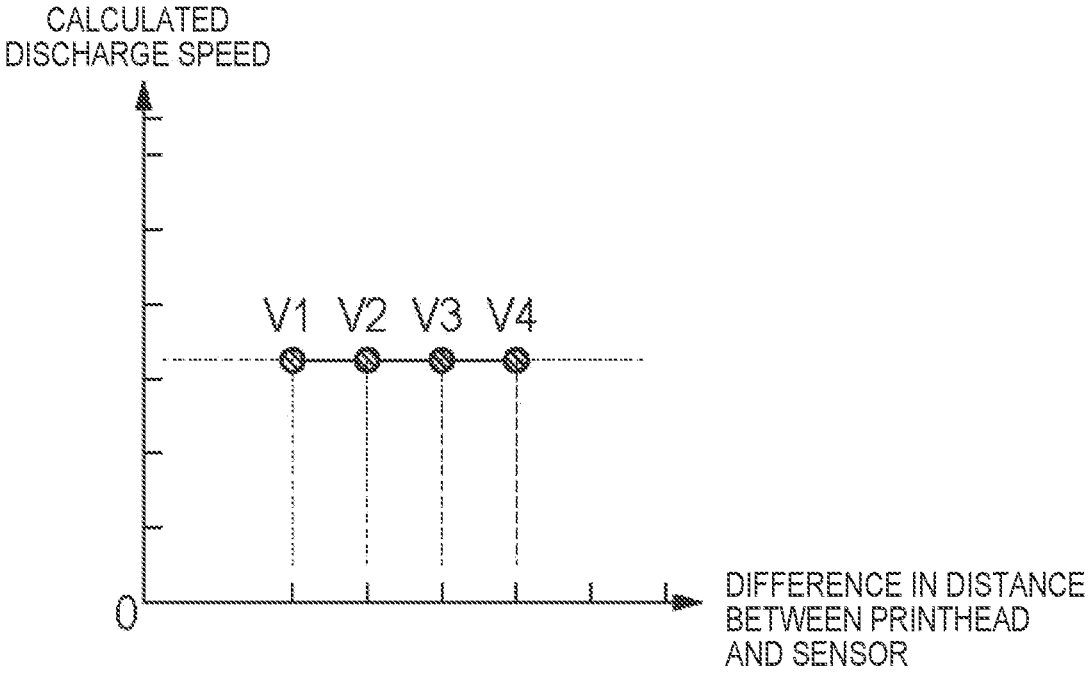
FIG. 6D is a graph showing the discharge speeds according to the first embodiment.

FIG. 6A and FIG. 6C are graphs each showing the output results of the distances between the orifice surface 201*a* and the light 404 of the droplet detecting unit 205 and the detection times of respective distances described in FIGS. 5A to 5D. FIG. 6B and FIG. 6D are views each showing the relationship between the discharge speeds calculated from the distances and the detection times shown in FIG. 6A and FIG. 6C and the differences between the distances.

In the graph shown in FIG. 6A, the ordinate indicates the detection time detected by the sequence control unit 307 and the abscissa indicates the distance between the orifice surface 201*a* of the printhead 201 and the light 404 of the droplet detecting unit 205. Each point indicated by a hatched circle in FIG. 6A is a point that has been actually measured. In this case, detection has been performed at the distances H1 to H5. The orifice surface 201*a* and the light 404 are set further apart from each other at the distance H5 than the distance H4.

In the graph shown in FIG. 6B, the ordinate indicates the discharge speed, and the abscissa indicates the difference between the separation distances. At this time, the calculated discharge speed data may be obtained as data that changes nonlinearly due to various kinds of influence. Hence, to more accurately calculate the discharge speed data indicated for each distance difference, an approximation curve of a second-order or a higher-order polynomial is obtained, and the polynomial of the obtained approximation curve is used as an expression of the discharge speed. To obtain the approximation curve, three or more discharge speeds will be used. To calculate three or more discharge speeds, the detection times at four or more distances need to be detected. The method of obtaining the discharge speed is as described above.

In addition, depending on the individual differences of the printheads, the differences of the physical properties of the respective ink colors, and the state of use and the environmental influence on the printing apparatus, data that changes linearly may be obtained. FIG. 6C shows such data that changes linearly. In this case as well, the discharge speed can be calculated from the detection time at each distance and the difference in the distances between the orifice surface 201*a* and the light 404. FIG. 6D shows a graph showing the relationship between the calculated discharge speed and each distance difference. As shown in FIG. 6D, the discharge speed calculated for each distance difference is constant at any distance difference. Since the discharge speed will be constant regardless of the distance in a case in which the data is determined to change linearly, only a single discharge speed will need to be obtained. To calculate a single discharge speed, the detection times can be obtained with respect to two distances.

In addition, even in a case in which the discharge speed changes nonlinearly, the calculation of the approximation curve need not be performed if printing is to be performed only when the distance between the orifice surface 201*a* and the print medium 203 is constant. In such a case, the detection times at two distances that include the distance to be used during printing can be detected.

Figure 7:
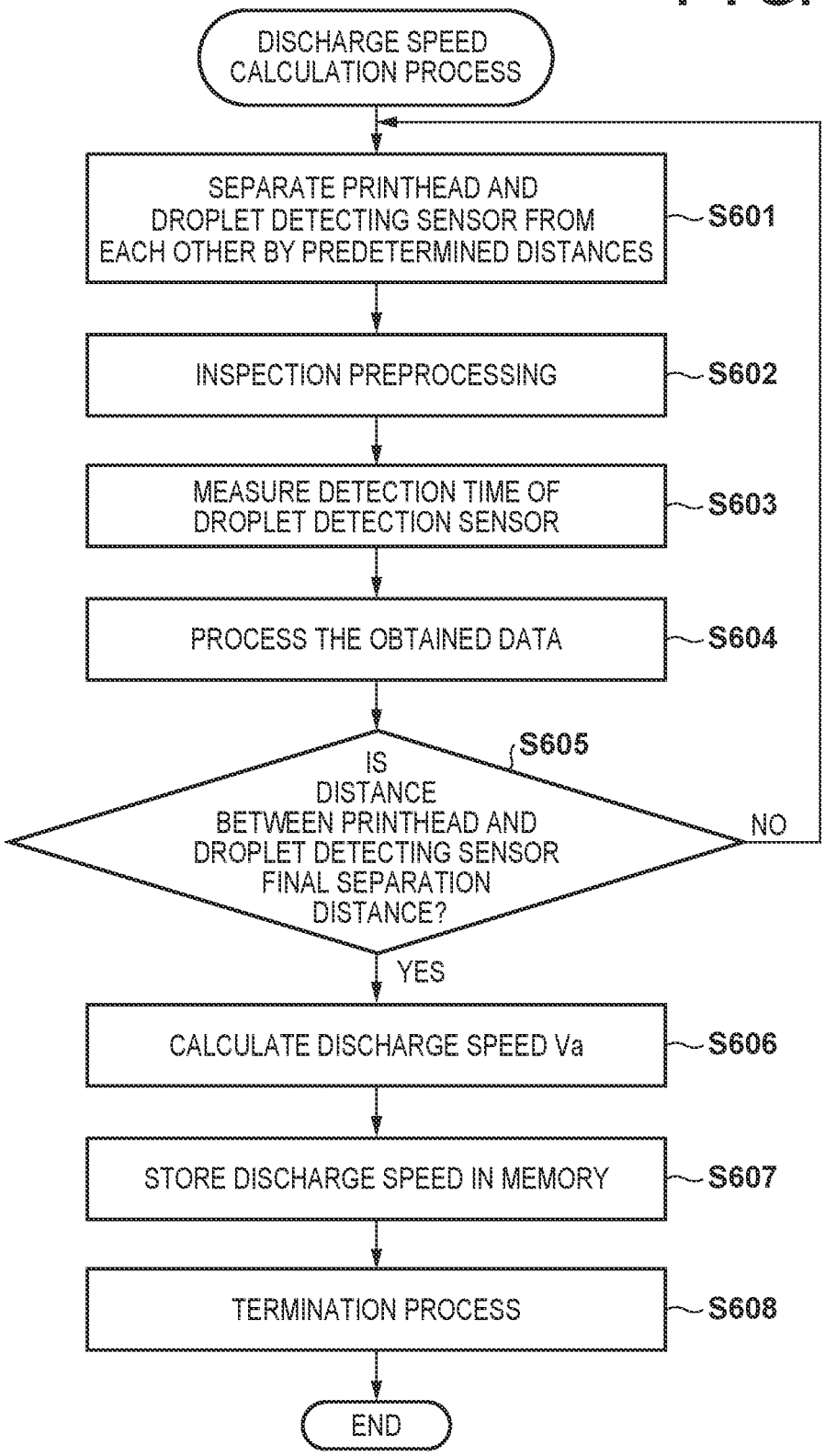
FIG. 7 is a flowchart of processing for calculating the discharge speed according to the first embodiment.

FIG. 7 shows a flowchart of discharge speed calculation processing. The discharge speed calculation processing of FIG. 7 is processing performed during an initial setting operation in which a user of the printing apparatus 100 operates the printing apparatus 100 for the first time and processing performed when the printhead 201 has been newly replaced. It may also be performed regularly as a maintenance operation or performed under the instruction of the user. The processing of FIG. 7 is, for example, processing performed by the sequence control unit 307 of the CPU 301 in accordance with a program stored in the memory 303. The execution of the processing of FIG. 7 by the sequence control unit 307 causes the operation shown in FIGS. 5A to 5D to be performed to obtain a calculation result as shown in FIGS. 6A to 6D.

First, in step S601, the sequence control unit 307 drives the lift motor 211 to separate the printhead 201 and the droplet detecting unit 205 from each other by predetermined distances. The separation distances are set in advance in the memory 303 and are the distances H1 to H4 described in FIGS. 5A to 5D in this embodiment. The order of the separation distances is set as the distance H1, the distance H2, the distance H3, and the distance H4 as described in FIGS. 5A to 5D.

Next, the process advances to step S602, and preprocessing necessary for detecting the discharge speed is executed. More specifically, presetting of discharge control suitable for detecting the discharge speed, a preliminary discharge operation for stable discharge of ink droplets, a suction fan stopping operation to stabilize air current control in the printing apparatus, and the like can be performed as preprocessing.

Next, the process advances to step S603, and a discharge operation for discharging an inspection ink droplet from the printhead 201 to the light 404 emitted by the light emitting element 401 of the droplet detecting unit 205 is performed. More specifically, the detection time, which is a period from when the printhead 201 starts to discharge an ink droplet from a predetermined nozzle to when the light receiving element 402 of the droplet detecting unit 205 has detected that the ink droplet has passed the light 404, is detected with respect to the separation distance set in step S601. A plurality of detection times will be detected in regards to the detection time by using a plurality of nozzles of the printhead 201. In order to accurately detect the discharge speed, it is desirable to select, as target nozzles to be used for detection time measurement, a wide range of nozzles including those at both ends and the center.

Next, the process advances to step S604, and data processing of the detection times obtained in step S603 is executed to calculate the detection time with respect to the set separation distance of step S601. More specifically, to stabilize the detection time measurement, data processing operations such as performing averaging based on a necessary obtained sample number, deleting data outside the upper and lower limits of the error range to prevent mixing of abnormal values in the data, and the like are executed.

Next, the process advances to step S605, and whether the detection time has been detected for all of the separation distances set in the memory 303 is determined. In this embodiment, this is determined by determining whether the current distance between the orifice surface 201*a* and the light 404 of the droplet detecting unit 205 is the distance H4 which is the final separation distance. If it is determined that the distance is not the distance H4, the process returns to step S601, an operation is performed to separate the printhead and the droplet detecting unit 205 by the next set separation distance, and the subsequent data obtainment and processing are executed. If it is determined in step S605 that the current distance is the distance H4, it will be determined that the detection time has been obtained with respect to all of the distances, and the process advances to step S606.

In step S606, discharge speed calculation is executed. More specifically, as described with reference to FIGS. 5A to 5D and FIGS. 6A to 6D, the discharge speed is calculated based on the difference between the respective distances and the detection time of each distance. After the discharge speed has been calculated, the process advances to step S607, and the information of the discharge speed calculated in step S606 is stored in the memory 303. The discharge speed information stored here will be subsequently used in the driving control of the printhead 201 and in the data processing in accordance with necessary processing operations.

Next, the process advances to step S608 to execute a termination process. More specifically, since the discharge speed calculation has been completed, the printhead 201 is returned to a predetermined position or shifted to a standby state for the next printing operation process. Furthermore, a cleaning process is performed on the printhead 201 based on the obtained discharge speed information and the like. Subsequently, the processing ends.

After the completion of the discharge speed calculation processing of FIG. 7, discharge timing adjustment is performed by obtaining a table which is stored in advance in the memory 303 and in which the discharge speeds are associated with discharge timing adjustment values, and obtaining a discharge timing adjustment value corresponding to the discharge speed obtained from the processing of FIG. 7. When image printing is to be performed, the timing control unit 309 will control the ink discharge timing in accordance with the print data.

As described above, according to this embodiment, the distance between the printhead 201 and the droplet detecting unit 205 is changed, and the time from the discharge of ink droplets to the detection of the ink droplets is detected for each of the plurality of distances. Subsequently, the discharge speed is calculated based on the difference between the distances and the difference between the detection times. As a result, the ink droplet discharge speed can be calculated accurately even if the apparatus has not been accurately assembled. In addition, by detecting the detection times of four or more distances, it will be possible to more accurately obtain the attenuation influence of the discharge speed with respect to the individual differences of the printing apparatuses or the printheads, the physical properties of the respective ink colors, the state of use of the printing apparatus or the environmental influence on the printing apparatus, and each separation distance. Furthermore, the degradation of image quality due to a landing position shift can be suppressed by adjusting the discharge timing based on the discharge speed.

Note that although the above-described embodiment has an arrangement in which the distance is changed by moving the printhead 201 with respect to the droplet detecting unit 205, it is sufficient as long as the distance between the droplet detecting unit 205 and the printhead 201 in the Z direction is changed in a relative manner. Hence, for example, it may be arranged so that the distance will be changed by moving the droplet detecting unit 205 in the Z direction.

In relation to the discharge speed calculation by the droplet detecting unit 205, a method in which the discharge speed is calculated based on the difference between the distances and the difference in the detection times has been described in the above-described embodiment. However, a method in which detection times are obtained for a plurality of distances and the discharge speed is calculated based on each distance and the detection time corresponding to the distance may also be employed.

In addition, in the above-described embodiment, it was arranged so that a wider range of target nozzles will be set for measuring the detection time for discharge speed calculation. However, it may be arranged so that discharge speed measurement will be performed by setting, in accordance with the state of use by the user, nozzles with a higher ratio of use in printing as the target nozzle.

Second Embodiment

The second embodiment will be described next. In the first embodiment, the thickness of a print medium 203 was not considered. However, since the print medium 203 has a thickness in reality, the distance between a orifice surface 201*a* and a platen 212 will be different from the distance between the orifice surface 201*a* and the print medium 203. In particular, in a case in which printing is to be performed by using a thick print medium 203, using an adjustment value determined based on the distance between the orifice surface 201*a* and the platen 212 may cause the discharge position to shift due to the fact that the distance between the orifice surface 201*a* and the print medium 203 is different from that between the orifice surface and the platen. Hence, in this embodiment, discharge timing adjustment is performed based on the distance between the orifice surface 201*a* and the print medium 203.

The distance between the orifice surface 201*a* and the print medium 203 is measured by a distance detecting sensor 204. The discharge timing control is performed based on the distance between a printhead 201 and the print medium 203 detected by the distance detecting sensor 204 and the discharge speed information calculated in the discharge speed calculation processing.

Figure 8A:
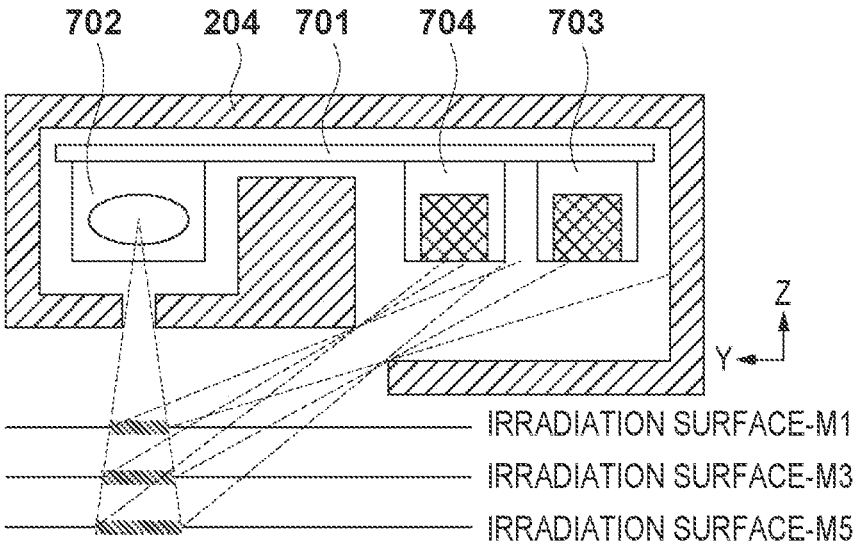
FIG. 8A is a view showing an example of the internal arrangement of a distance detecting sensor according to the second embodiment.
Figure 8B:
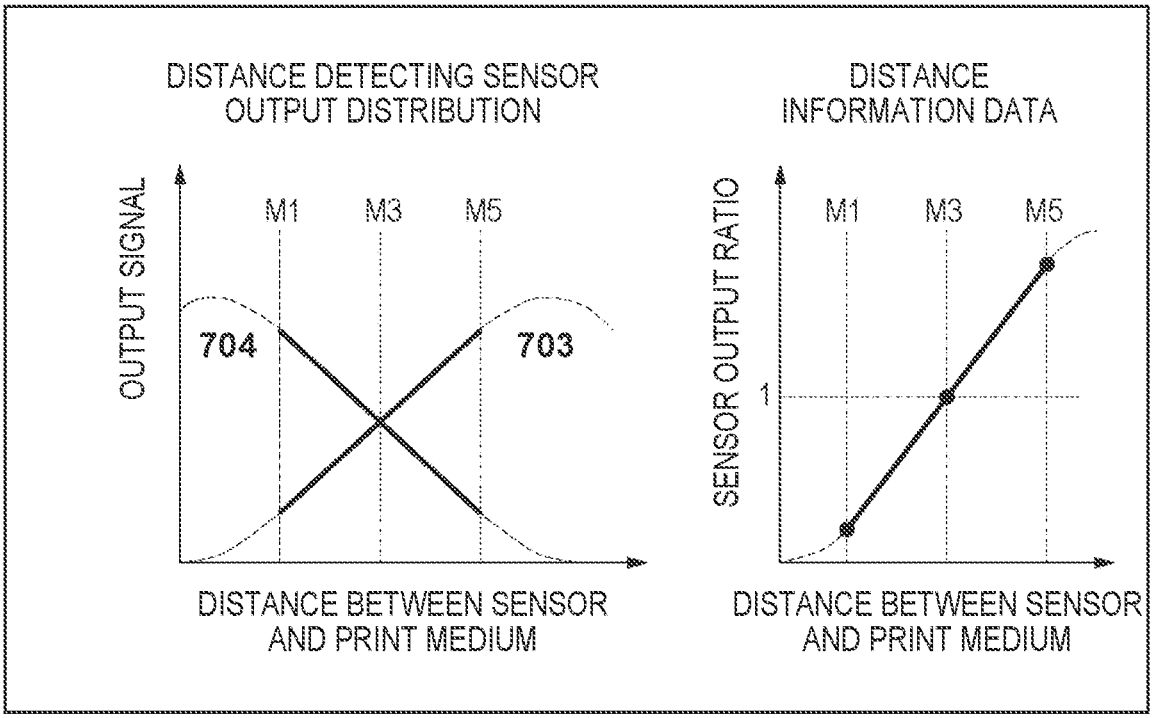
FIG. 8B is a view showing an example of detection by the distance detecting sensor.

FIG. 8A is a view showing the internal arrangement of the distance detecting sensor 204. FIG. 8B is a view showing a change in light amounts (outputs) of an irradiation region and a light receiving region which changes in accordance with the distance from the distance detecting sensor 204 to the irradiation surface of the print medium 203. As shown in FIG. 8A, the distance detecting sensor 204 includes a control substrate 701 which executes processing to turn on and off a light source at the conveyance position of the print medium 203, a light emitting unit 702 for emitting the light, and a light receiving unit 703 and a light receiving unit 704 for receiving the reflected light. In this embodiment, the surface of the distance detecting sensor 204 that faces the print medium 203 is in a position identical to the orifice surface 201*a* of the printhead 201 in the Z direction. Hence, the distance to the print medium 203 that is measured by the distance detecting sensor 204 will correspond to the distance between the orifice surface 201*a* of the printhead 201 and the print medium 203.

Furthermore, the intensity of reflected light obtained by each of the light receiving units 703 and 704 is converted into an output signal based on a current value or a voltage value, predetermined arithmetic processing is performed on the output signal, and the obtained result is stored in a memory 303. For example, distance information data that indicates the relationship between the value of the ratio of output signals obtained by the light receiving units 703 and the light receiving unit 704 and the distance from the printhead 201 to the print medium 203 is stored in the memory. FIG. 8B shows the relationship between the distance, the output signal, and the distance information data.

As shown in FIG. 8B, when the distance from the irradiation surface of the print medium 203 is M1, the amount of reflected light to the light receiving unit 704 will be maximum and the amount of reflected light to the light receiving unit 703 will be minimum. Hence, the output signal ratio value, that is, the distance information data, of the distance detecting sensor 204 will also be minimum. Also, when the irradiation surface of the print medium is M3, the amount of light reflected to each of the light receiving units 703 and 704 will be half of the peak amount. Hence, since the output distribution of the distance detecting sensor reflected on the light receiving unit 703 and that on the light receiving unit 704 are equal, the output signal ratio value, that is, the distance information data of the distance detecting sensor 204 will be 1. Furthermore, when the irradiation surface of the print medium is at a distance M5, the amount of light reflected to the light receiving unit 704 will be minimum and the amount of reflected light to the light receiving unit 703 will be maximum. Hence, the output distribution of the distance detecting sensor will be minimum for the light receiving unit 704 and maximum for the light receiving unit 703, and the output signal ratio value, that is, the distance information data of the distance detecting sensor 204 will also be maximum.

Note that the relationship between a position on the irradiation surface to be a reference and an output signal ratio value of the distance detecting sensor 204 may be obtained in advance and stored in the memory 303. For example, a value detected for a printing medium of a predetermined thickness can be held as a reference value. In addition, the positions of the printhead 201 when the distance from the printhead 201 to the print medium 203 changes between the distances M1 to M5 and the distance from the printhead 201 to a droplet detecting unit 205 for each distance can also be stored in advance.

Figure 9A:
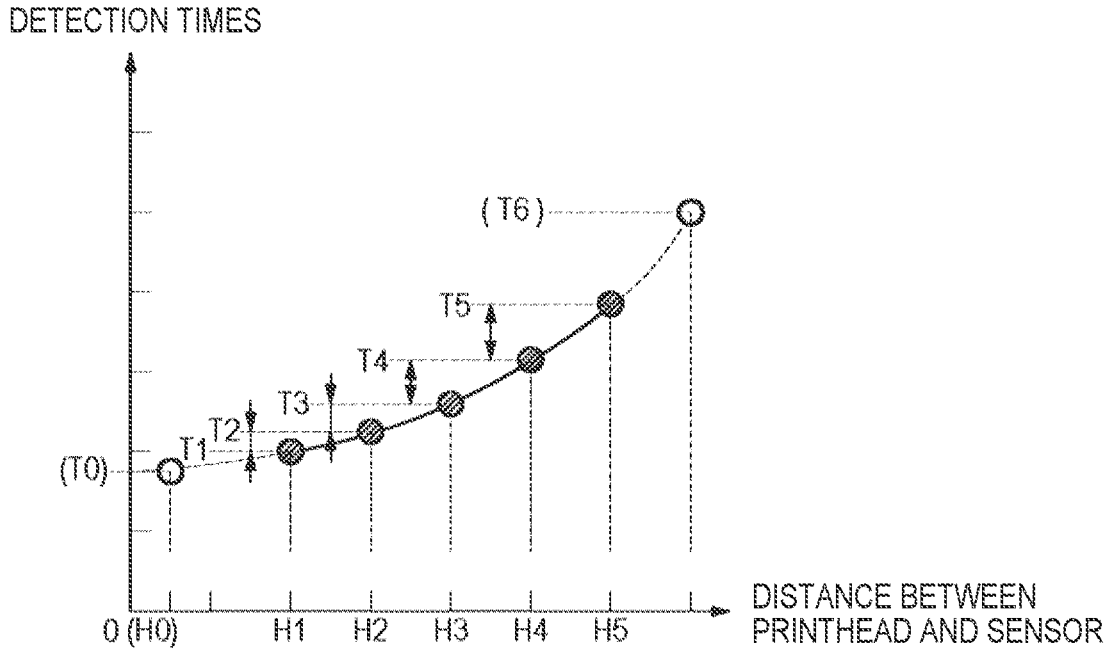
FIG. 9A is a graph showing detection times according to the second embodiment.
Figure 9B:
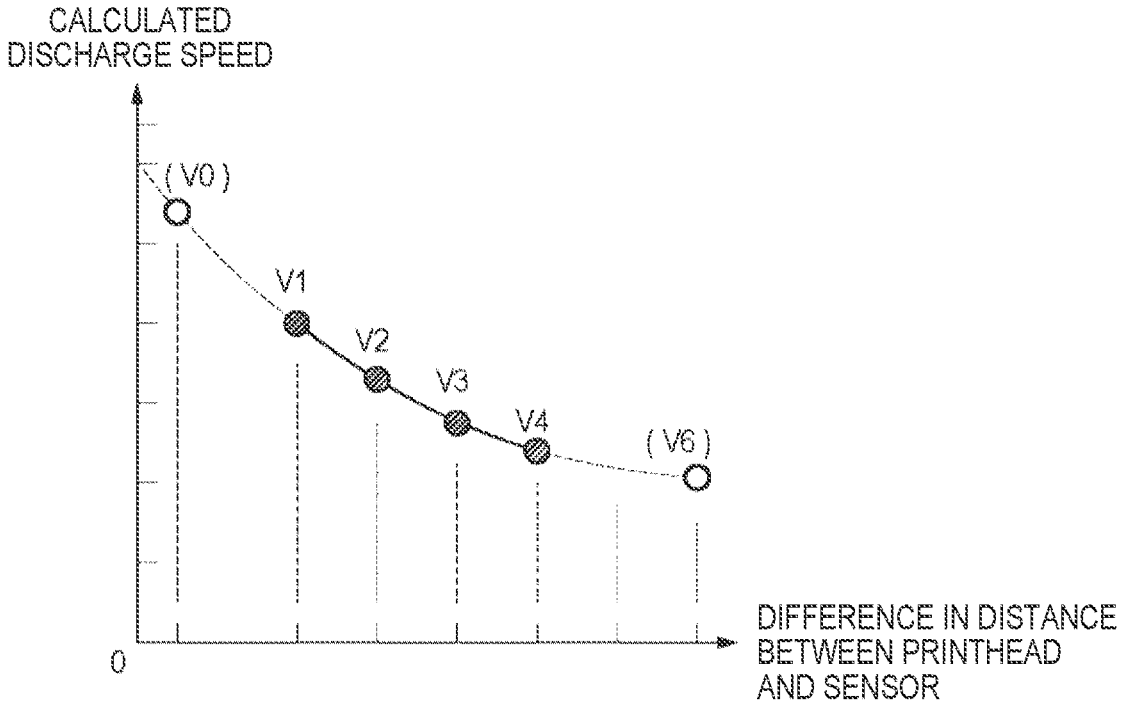
FIG. 9B is graph showing discharge speeds according to the second embodiment.

FIG. 9A is a graph showing distances H1 to H5 by which the droplet detecting unit 205 and the printhead 201 were separated from each other and the output results of detection times detected at the respective distances by the droplet detecting unit 205. FIG. 9B is a view showing the relationship of the discharge speeds calculated from the distances and the respective detection times shown in FIG. 9A. The detection time and the discharge speed are obtained by a method similar to the method described in FIGS. 6A to 6D of the first embodiment. In FIG. 9A and FIG. 9B, the detection time at each of the distances H1 to H5 is obtained, and discharge speeds V1 to V5 that correspond to the respective distances are calculated. After each discharge speed has been obtained, an approximation curve representing the discharge speeds will be obtained from the obtained discharge speeds in a manner similar to the first embodiment.

To determine the discharge timing adjustment value, first, the print medium 203 is conveyed onto the platen 212, and the distance detecting sensor 204 measures the distance between the conveyed print medium 203 and the orifice surface 201*a*. Subsequently, a speed corresponding to the measured distance between the orifice surface 201*a* and the print medium 203 is obtained from the discharge speed approximation curve. In this manner, a more accurate discharge speed can be calculated by calculating the ink droplet discharge speed from the actually measured distance between the orifice surface 201*a* and the print medium 203.

A measurement point is indicated by a hatched circle in FIG. 9A. FIG. 9A shows the ink droplet detection times obtained when the printhead 201 and the droplet detecting unit 205 are separated by distances H1 to H5. FIG. 9B shows the relationship between the discharge speeds calculated based on FIG. 9A and the respective distance differences. At this time, it will be possible to estimate the detection time and the discharge speed of a distance (such as H0, H6, or the like) other than the measured distances H1 to H5 by performing complementation processing on the approximation curve based on the output results of the detection times measured for the distances H1 to H5. In addition, other than obtaining the speed with respect to a distance, such as the distance H0 or H6, outside the section of distances H1 to H5, it will be possible to obtain the speed or the like with respect to the distance of a section between the distance H1 and the distance H2.

For example, assume that the discharge speed has been calculated for a case in which the distance between the orifice surface 201*a* and the droplet detecting unit 205 is 1.0 mm, and the discharge speed has been calculated for a case in which the distance between the orifice surface 201*a* and the droplet detecting unit 205 is 1.5 mm. In this case, if the distance between the orifice surface 201*a* and the print medium 203 measured by the distance detecting sensor 204 is 1.1 mm, the discharge speed of the case in which the distance is 1.1 mm can be calculated by executing linear complementation on the calculated discharge speeds.

Although the distance between the orifice surface 201*a* and the print medium 203 is measured by the distance detecting sensor 204 in the above description, another method may be used. For example, it may be arranged so that the thicknesses of various kinds of print media which are to be set as targets will be stored in the memory 303, and the user may select a target print medium from the operation panel on the printing apparatus 100 to set a corresponding distance. The distance detecting sensor may not be included in the printing apparatus if such an arrangement is to be employed.

When the discharge speed for the distance between the orifice surface 201*a* and the print medium 203 is calculated, the discharge timing adjustment value is obtained from the table held in the memory 303 and the calculated discharge speed in a manner similar to the first embodiment.

As described above, a more accurate discharge speed can be calculated by calculating the ink droplet discharge speeds based on the distances between the orifice surface 201*a* of the printhead 201 and the print medium 203. By adjusting the discharge timing based on such an accurate discharge speed, it will be possible to suppress a landing position shift.

Third Embodiment

The third embodiment will be described next. The ink droplet discharge speed can gradually decrease if a printhead is used over a long period. If the discharge speed has decreased from when the detection time adjustment value was set, the ink droplet landing position may shift if the set adjustment value is maintained when printing is to be performed by reciprocally moving the printhead. Hence, this embodiment will describe a mode in which the discharge timing adjustment value is reset at a predetermined timing after the discharge timing adjustment value has been set once. A description of parts similar to those of the above described embodiments will be omitted in this embodiment.

Figure 10:
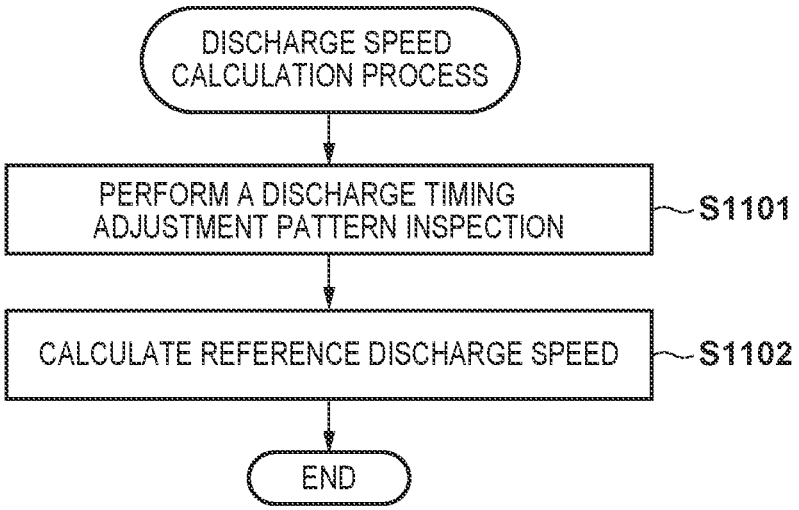
FIG. 10 is a flowchart of processing for calculating a discharge speed according to the third embodiment.

FIG. 10 is a flowchart showing processing for determining a discharge timing adjustment value from an adjustment pattern and calculating a discharge speed from the determined adjustment value. The processing of FIG. 10 is, for example, processing performed by a sequence control unit 307 of a CPU 301 in accordance with a program stored in a memory 303. This processing is started at the initial installation of a printing apparatus or when a printhead has been newly replaced. In addition, the processing may be started when a user has issued, on an operation panel of a printing apparatus 100, an instruction to adjust the discharge timing by printing out an adjustment pattern. The ink droplet discharge speed calculated by the processing of FIG. 10 will be set as the reference discharge speed.

First, in step S1101, a discharge timing adjustment pattern inspection is performed. More specifically, printing of an adjustment pattern for obtaining a discharge timing adjustment value is performed, and the adjustment value is determined from the adjustment pattern.

Figure 11:
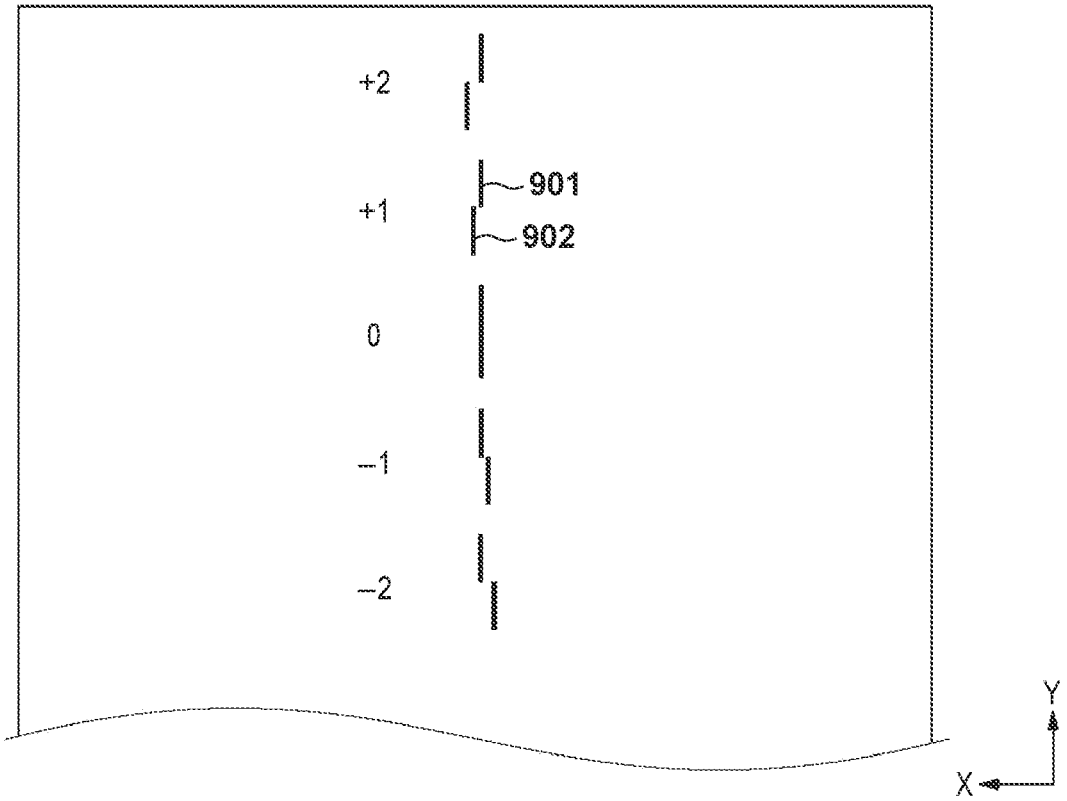
FIG. 11 is a view showing a pattern for adjusting a printing position shift according to the third embodiment.

FIG. 11 shows a pattern to be used for adjusting printing position shifts in the forward direction and the backward direction. Each vertical line 901 is a line pattern printed by 64 nozzles of each nozzle array in a scanning operation in the forward direction. Each vertical line 902 is a line pattern printed by 64 nozzles of each nozzle array in a scanning operation in the backward direction. When printing these line patterns, a carriage speed of 25 in/sec and a driving frequency of 30 kHz are set as the printing conditions. The adjustment pattern is constituted by five line patterns obtained by changing the discharge timing during the scanning operation in the backward direction so that the printing positions of the vertical lines 902 will change between five levels from "−2" to "+2" on a 1/1,200 inch basis with respect to the corresponding vertical lines 901 as a reference. Note that the − direction indicates that the printing timing has been advanced with respect to the reference, and the + direction indicates that the printing timing has been delayed with respect to the reference. A set of line patterns with the smallest shift between the two vertical lines will be selected among such an adjustment pattern, and the selected adjustment value will be stored in the memory 303. The discharge timing in the scanning direction in which the vertical lines on the non-reference side have been printed will be determined based on the selected adjustment value. Note that if the printing apparatus includes an optical sensor on the carriage, it may automatically perform the detection of a set of line patterns with the smallest shift between the two vertical lines. In addition, it may be arranged so that the user can input the value of the set of line patterns with the smallest shift between the two vertical lines upon observing a print sheet printed with the adjustment pattern.

The process advances to step S1102, and the discharge speed at the point of time when the adjustment pattern was printed is calculated based on the adjustment value obtained in step S1101. A discharge speed at the time of printing of the adjustment pattern will be referred to as a reference discharge speed hereinafter. The calculation method of the reference discharge speed will be described with reference to FIGS. 4A and 4B.

First, after the adjustment value has been determined, a landing position shift amount from the adjustment value ("0" in this case) from the reference discharge timing can be determined. The shift amount is shift amount=Xa'−Xa as described in FIG. 4B. For example, if the adjustment value is determined to be "−1", the shift is minimized by shifting discharge position from the reference by 1/1,200 inches. Since this is a shift amount obtained by combining the shifts in the forward and backward directions, the shift amount Xa'−Xa in a scanning operation in one direction is 1/2,400 inches. Note that a distance Xa between the discharge position and the landing position according to the reference discharge speed is stored in advance in the memory 303. As described above, since the shift amount and the distance Xa are already known, it is possible to calculate a distance Xa' to a discharge position according to the current reference discharge speed.

As described in FIGS. 4A and 4B, the distance Xa' from the discharge position to the landing position according to the current reference discharge speed is Xa'=(H/Va')×Vcr. Based on this equation, a current reference discharge speed Va' is calculated as follows.

$$Va'=(H\times Vcr)/Xa' \quad (8)$$

A distance detecting sensor 204 will measure a distance H between an orifice surface 201*a* and a print medium 203. In addition, a scanning speed Vcr of a printhead 201 is already stored in the memory 303. The distance Xa' from the discharge position to the landing position according to the current reference discharge speed is calculated, as described above, based on the distance Xa and the shift amount obtained from the adjustment value determined from the adjustment pattern. By substituting each value in the equation, the current reference discharge speed Va' can be calculated. The current reference discharge speed Va' that has been calculated is stored in the memory 303. In this embodiment, the line patterns when the distance between the orifice surface 201*a* and the print medium 203 are at a distance M1, a distance M3, and a distance M5 are printed, and a discharge speed is calculated for each distance. The adjustment value is determined by the above-described processing, and a reference discharge speed is calculated from the adjustment pattern.

The discharge speed will decrease with time as the printhead 201 is used. If the discharge speed decreases, the landing position will shift when printing is performed based on the adjustment value determined by the adjustment pattern. Hence, an attenuation factor of the discharge speed after the previous discharge speed calculation will be obtained by performing discharge speed calculation by using a droplet detecting unit 205, described in the first and second embodiments, at a predetermined timing after the adjustment pattern has been printed. The discharge speed adjustment value will be set based on this attenuation factor. This process will be described in detail with reference to FIG. 13.

Figure 12A:
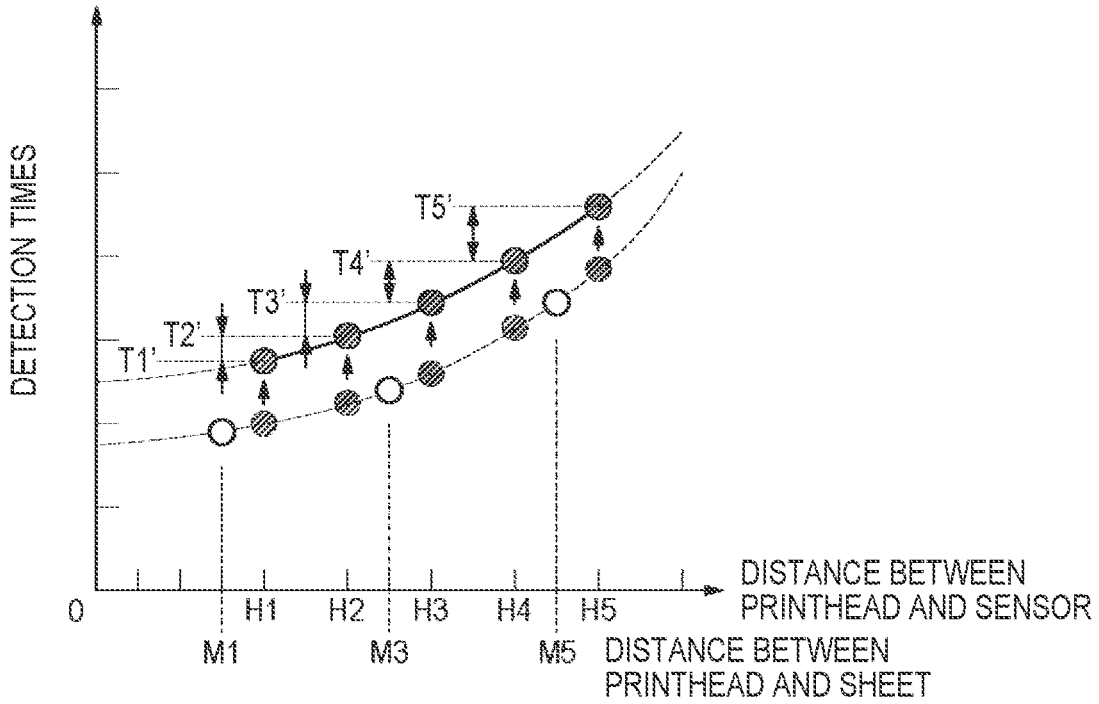
FIG. 12A is a graph showing detection times according to the third embodiment.
Figure 12B:
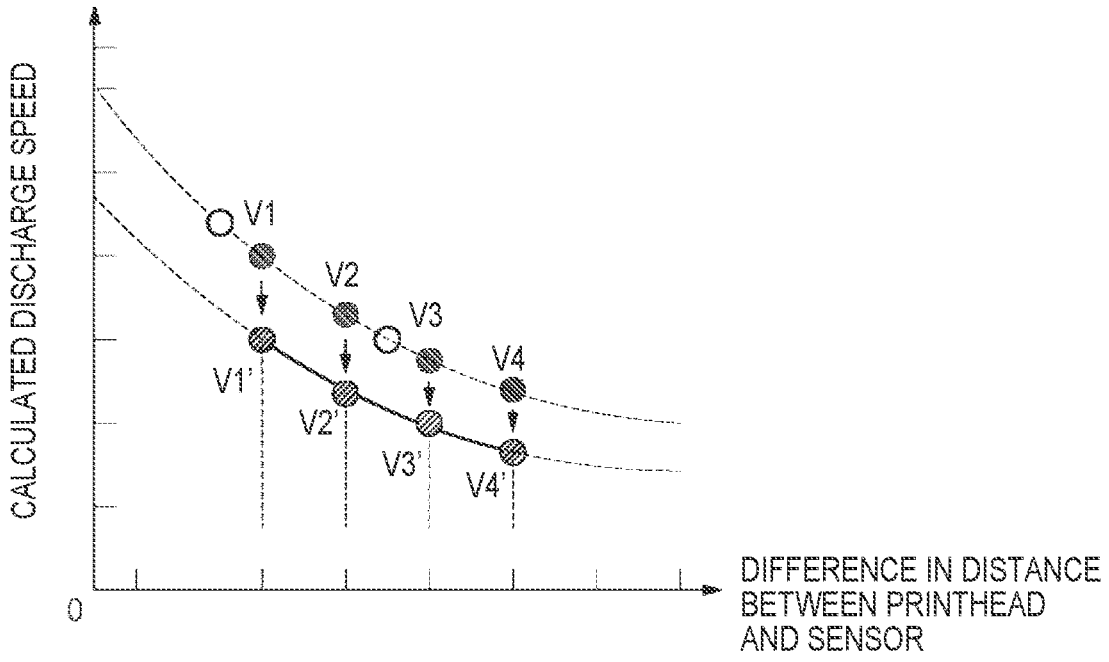
FIG. 12B is a graph showing discharge speeds according to the third embodiment.

FIGS. 12A and 12B are graphs for explaining the discharge speeds calculated based on the reference discharge speed and the detection times detected by the droplet detecting unit 205. In this case, the detection of each detection time by the droplet detecting unit 205 is performed at a timing after the timing at which the adjustment pattern was printed to calculate the reference discharge speed.

FIG. 12A is a graph showing the distances between the orifice surface 201*a* and a platen 212 or the print medium 203 and the output results of detection times at respective distances. The abscissa indicates distances (H1 to H5 or the like) between the orifice surface 201*a* of the printhead 201 and light 404 of the droplet detecting unit 205 or distances (M1 to M5) between the orifice surface 201*a* and the print medium 203. The ordinate indicates the detection times detected by the droplet detecting unit 205. FIG. 12B shows the discharge speeds corresponding to the detection times and the distances of FIG. 12A.

Each value indicated by a white circle in FIG. 12B is a reference discharge speed, calculated in accordance with the processing of FIG. 10, when the distance between the orifice surface 201*a* and the print medium 203 is at corresponding one of the distances M1, M3, and M5. Although it will not be actually calculated, the detection times when the reference discharge speeds corresponding to FIG. 12B are obtained indicated by white circles in FIG. 12A. By obtaining an approximation curve of the speeds based on the speeds indicated by the white circles in FIG. 12B, the discharge speeds corresponding to the distances H1 to H5 can be calculated. The detection times and the discharge speeds that are calculated here are indicated by hatched circles each surrounded by a dotted line.

Next, at a predetermined timing, in a manner similar to the first embodiment, the detection times at the distances H1 to H5 are indicated as detection times T1' to T5' that have been detected by the droplet detecting unit 205 by using hatched circles each surrounded by a solid line in FIG. 12A. Discharge speeds V1' to V4' calculated from the detection times Ti' to T5' are indicated by hatched circles each surrounded by a solid line in FIG. 12B. A discharge speed approximation curve can be obtained from the discharge speeds V1' to V4'.

Figure 13:
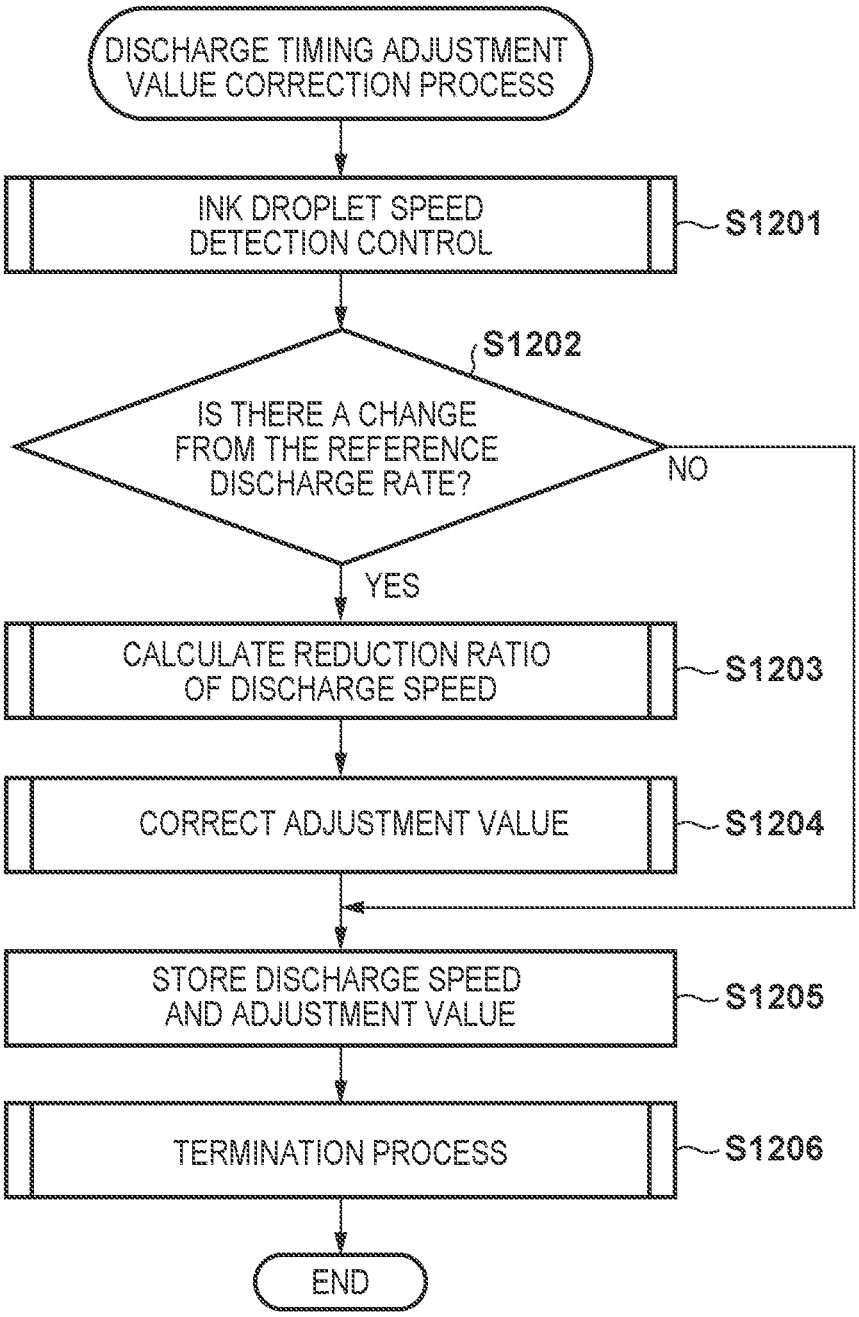
FIG. 13 is a flowchart of discharge timing correction processing according to the third embodiment.

FIG. 13 is a flowchart of discharge timing correction processing. In this processing, the detection of the detection times is performed at a timing after the timing of the printing of the adjustment pattern for calculating the reference discharge speed. For example, this processing is performed when a predetermined time has elapsed since the previous discharge speed calculation, when a predetermined number of ink droplets have been discharged, or a predetermined number of sheets have been printed. In this embodiment, assume that the processing of FIG. 10 has been completed before the processing of FIG. 13 is started. That is, discharge speeds V1 to V4 shown in FIG. 12B have been calculated before the processing of FIG. 13 is started, and the values of these discharge speeds are already stored in, for example, the memory 303. The processing of FIG. 13 is, for example, processing performed by the sequence control unit 307 of the CPU 301 in accordance with a program stored in the memory 303.

First, in step S1201, the calculation of discharge speeds of the ink droplets to be discharged from the printhead 201 is performed by processing similar to the discharge speed detection processing of FIG. 7 according to the first embodiment. The speeds calculated here are the discharge speeds V1' to V4' shown in FIG. 12B.

Next, in step S1202, whether the discharge speed has changed is determined by comparing each reference discharge speed obtained by the processing of FIG. 10 and the corresponding discharge speed calculated in step S1201. The determination is performed by determining whether the difference between the reference discharge speed and the corresponding speed calculated in step S1201 is equal to or greater than a threshold stored in advance in the memory 303. If the difference is equal to or greater than the threshold, the process advances to step S1203. If the difference is less than the threshold, the process advances to step S1205.

If the process advances to step S1203, the attenuation factor of the ink droplet discharge speed obtained in step S1201 with respect to the reference discharge speed is calculated.

Next, the process advances to step S1204, and the correction processing of the discharge timing adjustment value is executed based on the reduction ratio with respect to the reference discharge speed calculated in step S1203. The adjustment value can be corrected by calculating, based on the attenuation factor, how much the adjustment value is to be shifted from the adjustment value of a case in which the ink droplet discharge speed is at the reference discharge speed.

Next, the process advances to step S1205, and each calculated discharge speed and the correction processing result are stored in the memory 303. Subsequently, a termination process is performed in step S1206. The termination process is a process similar to the process of step S608 of FIG. 7 according to the first embodiment.

As described above, by correcting the discharge timing adjustment value, it will be possible to set an appropriate discharge timing adjustment value for the current ink droplet discharge speed. As a result, image quality degradation can be suppressed.

In addition, the discharge speed calculation using the droplet detecting unit 205 may be performed at a timing after a predetermined time has further passed from the completion of the processing of FIG. 13 or at a timing when a predetermined number of sheets are to be printed. In such a case, an appropriate discharge timing adjustment value can be set by performing the processing of FIG. 13 by setting each discharge speed calculated in step S1201 of FIG. 13 as a reference speed.

In step S1204 of the processing of FIG. 13, the ink landing position shift was corrected by correcting the discharge timing adjustment value. However, another method may also be employed. For example, the pulse width of the driving pulse applied to the printhead 201 for ink discharge may be increased. Increasing the pulse width in accordance with the attenuation factor of the discharge speed will allow the discharge speed to be increased, thereby correcting the discharge speed.

Although it has been described above that the initial reference discharge speed is calculated based on the adjustment pattern, the discharge speeds may be calculated by using the droplet detecting unit 205 at the timing of the printing of the adjustment pattern. In addition, it may be arranged so that an adjustment value will be determined first based on the discharge speeds calculated by using the droplet detecting unit 205, and the adjustment value will be updated by subsequently printing a pattern.

Furthermore, if it is arranged so that the initial adjustment value will be set based on the discharge speeds calculated by using the droplet detecting unit 205, it will be possible to apply this embodiment to an arrangement which does not have a function for printing the adjustment pattern for obtaining a discharge timing adjustment value.

(Arrangement Examples of Periphery of Droplet Detection Unit)

A method of specifying an ink droplet discharge speed based on the detection results of the droplet detecting unit 205 has been mainly described with reference to FIGS. 1 to 13. However, the discharge speed specification accuracy depends on the measurement accuracy of the detection time from the discharge of an ink droplet by the printhead 201 to the detection of the ink droplet by the droplet detecting unit 205. Hence, an example of an arrangement that reduces an error in the detection time obtained based on the detection result of the droplet detecting unit 205 will be described hereinafter with reference to FIGS. 14A to 18.

(Arrangement Example 1 (FIG. 14A to FIG. 15B))

Figure 14A:
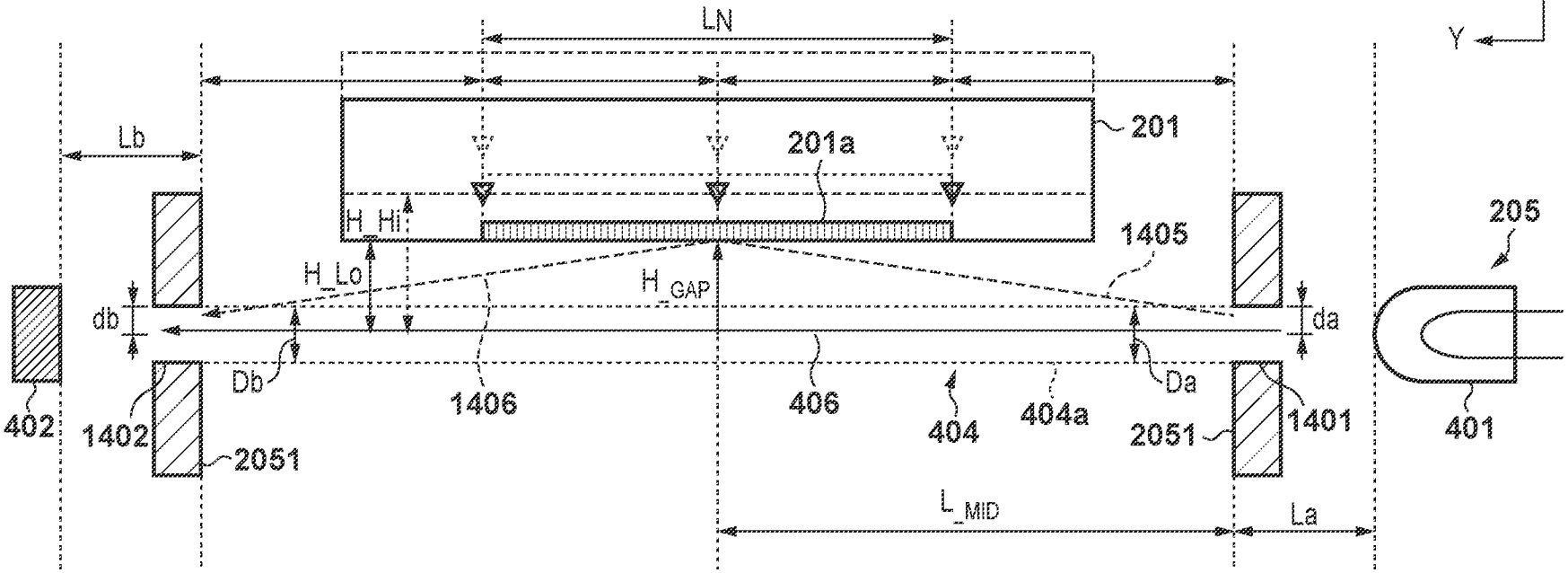
FIG. 14A is a schematic view showing a section of a printhead and a droplet detection unit obtained when a printing apparatus is cut along a section Y-Z.

FIG. 14A shows a schematic view of the printhead 201 and the droplet detecting unit 205 when the printing apparatus 100 is cut along a section Y-Z. This arrangement example will describe an arrangement that reduces the detection time error by the shapes of a housing 2051 and an opening 1401.

The droplet detecting unit 205 is formed by a light emitting element 401, a light receiving element 402, a control circuit substrate 403 (see FIGS. 5A to 5D. Not shown in FIG. 14A), and the housing 2051 which accommodates these components. The opening 1401 is formed in a portion, of the housing 2051, which is near the light emitting element 401, and a light beam 404 is formed when light emitted from the light emitting element 401 passes the opening 1401. An opening 1402 is formed in a portion, of the housing 2051, which is near the light receiving element 402, and the S/N ratio can be improved when the light receiving element 402 receives light that has passed through the opening 1402.

Here, as described in FIGS. 5A to 5D, when an ink droplet passes a region where the light beam 404 is formed, the light beam 404 will be shielded by the ink droplet, and the amount of light received by the light receiving element 402 will decrease. Hence, the sequence control unit 307 can measure the time from the discharge of an ink droplet by the printhead 201 until the detection of a reduction in the received light amount of the light receiving element 402 to obtain the detection time.

This detection time may sometimes include a large error due to the physical arrangement of the droplet detecting unit 205 and its periphery. For example, the light beam 404 formed by the opening 1401 may include a ray of light that linearly propagates, that is, propagates in a straight line parallel to the Y-axis from the light emitting element 401 to the light receiving element 402, and a ray of light that propagates diagonally with respect to the Y-axis. In the example of FIG. 14A, straight light 404*a* that propagates, to the light receiving element 402, in a straight line parallel to the Y-axis, and diffused light 1405 that propagates diagonally from the opening 1401 to the side (+Z side) of the printhead 201 to the light receiving element 402 are shown.

When the diffused light 1405 enters the orifice surface 201*a* after passing the opening 1401, reflected light 1406 which is a part of light irregularly reflected by the orifice surface 201*a* will enter the light receiving element 402. Particularly, in the detection of an ink droplet that is discharged from an orifice at the center position of the orifice surface 201*a* in the Y direction, an angle of incidence of the diffused light 1405 will have a value close to an angle of reflection of the reflected light 1406, thus allowing the reflected light 1406 to easily enter the light receiving element 402. This can cause a detection error to be generated. More specifically, if the diffused light 1405 or its reflected light 1406 is shielded by an ink droplet, the received light amount of the light receiving element 402 will decrease in a state in which the ink droplet is present in a region higher than the region of the straight light 404*a*. Hence, a detection time error will be obtained because the detection time will be shorter than that in the case in which the straight light 404*a* is shielded by the ink droplet.

Therefore, from the point of view of reducing a detection time error, it is preferable to suppress a state in which the light receiving element 402 will receive the reflected light 1406 emitted from the light emitting element 401 and reflected by the orifice surface 201*a*. Hence, the shapes, the dimensions, and the like of the housing 2051 and its opening 1401 to be used for this will be described below.

FIG. 14A shows a case in which H_Lo is a distance, in the height direction (Z direction), from the orifice surface 201*a* of the printhead 201 to an optical axis 406 of the light beam 404 emitted by the light emitting element 401. This distance H_Lo corresponds to, for example, the distance H1 of FIG. 5A and is a distance when the orifice surface 201*a* and the straight light 404*a* are closest to each other during a detection time measurement operation. Note that in this embodiment, the optical axis 406 is the center of the straight light 404*a* that propagates in the Y direction (optical-axis direction) of the light beam 404.

Figure 14B:
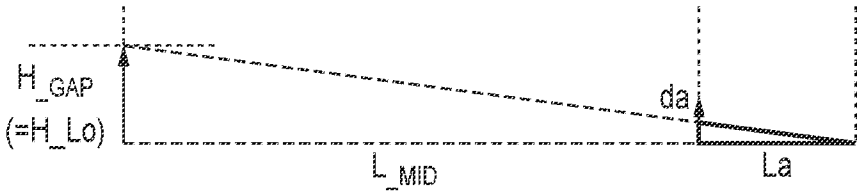
FIG. 14B is a view showing a positional relationship between the printhead and light emitted by a light emitting element of FIG. 14A.

FIG. 14B is a view showing the positional relationship between the light emitted by the light emitting element 401 and the printhead 201 in the case shown in FIG. 14A. A distance La indicates a distance, in the Y direction, from the light emitting element 401 to a far-end portion (to be sometimes referred to as a far end hereinafter), with respect to the light emitting element 401, of the opening 1401. A distance L_MID indicates a distance from the far end of the opening 1401 to the center of the orifice surface 201*a* in the Y direction.

Here, in FIGS. 14A and 14B, a distance, in the Z direction, between the diffused light 1405 and the optical axis 406 at a position identical to the center position of the orifice surface 201*a* in the Y direction is indicated as a distance H_GAP. In other words, the distance H_GAP is a Z value of the diffused light 1405 when Y=La+L_MID in a case in which the light emission position of the light emitting element 401 is the origin.

At this time, the distance H_GAP can be obtained based on the relation between the ratios of the distance La, the distance L_MID, and a radius da of the opening 1401 from the center of the light beam. That is, $$H_\mathrm{GAP}: da=(La+L_\mathrm{MID}): La \tag{9}$$

Hence, $$H_\mathrm{GAP}=da\times\{(La+L_\mathrm{MID})/La\} \tag{10}$$

FIGS. 14A and 14B show a case in which H_Lo=H_GAP. However, in this case, the diffused light 1405 can enter the center position of the orifice surface 201*a* in the Y direction and its reflected light 1406 can enter the light receiving element 402. Therefore, the detection time may become shorter than the time it takes for an ink droplet discharged from the printhead 201 to reach the optical axis 406.

On the other hand, in a case in which $$H_\mathrm{Lo}>H_\mathrm{GAP} \tag{11}$$

is satisfied, the diffused light 1405 will not reach the center position of the orifice surface 201*a* in the Y direction. In other words, it will be possible to suppress, while using the housing 2051 and the opening 1401 formed thereof to shield a part of the light emitted from the light emitting element 401 to form the light beam 404, a state in which the light emitted from the light emitting element 401 will enter the center portion of the orifice surface 201*a* in the Y direction. Hence, it will be possible to suppress the reflected light 1406 from entering the light receiving element 402 and reduce the generation of a detection time error. From a certain aspect, the housing 2051 and the opening 1401 thereof function as a suppression unit that suppresses the light receiving element 402 from receiving light that has been emitted from the light emitting element 401 and has been reflected by the orifice surface 201*a*.

To offer a more specific description in accordance with the example of FIG. 14A, the distance H_GAP can be reduced by either (a) decreasing the radius da of the opening, (b) decreasing the distance L_MID, or (c) increasing the distance La. Hence, by setting the relation between the radius da of the opening, the distance L_MID, and the distance La so as to satisfy equation (11), it will be possible to suppress the light receiving element 402 from receiving the light that has been emitted from the light emitting element 401 and has been reflected by the orifice surface 201*a*.

Figure 15A:
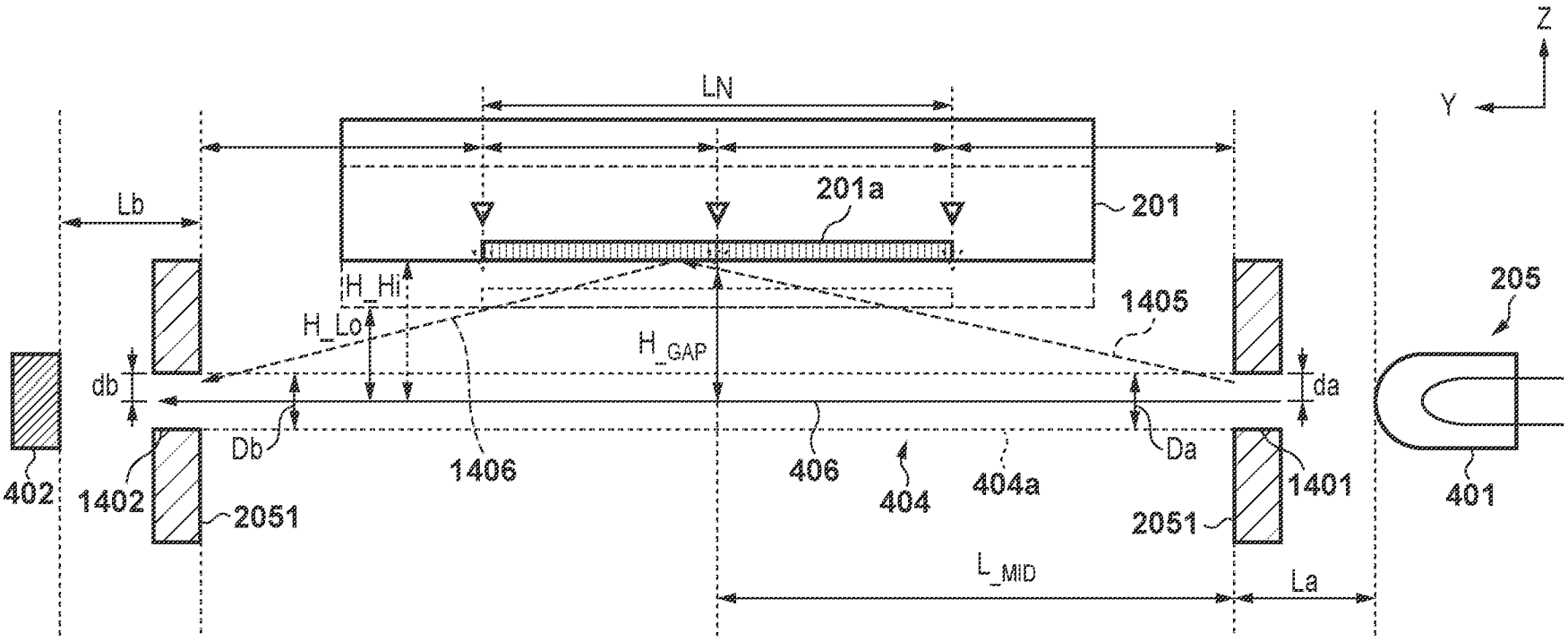
FIG. 15A is a schematic view showing the section of the printhead and the droplet detection unit obtained when the printing apparatus is cut along the section Y-Z.
Figure 15B:
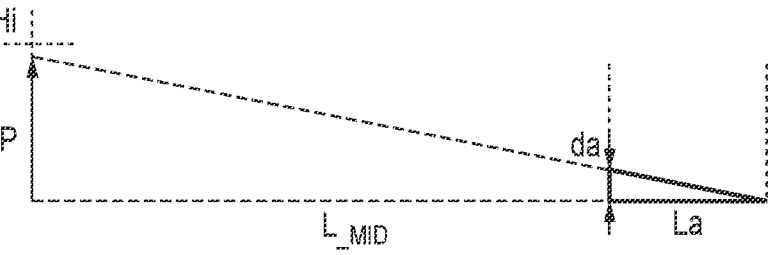
FIG. 15B is a view showing the positional relationship between the printhead and the light emitted by a light emitting element of FIG. 15A.

FIG. 15A shows a case in which the distance between the printhead 201 and the optical axis 406 is set to a distance H_Hi, which is more apart than the state shown in FIG. 14A to specify the discharge speed of each discharged ink droplet. This distance H_Hi corresponds to, for example, each of the distances H2 to H4 in FIGS. 5B to 5D and is a distance of a case in which the distance between the orifice surface 201*a* and the straight light 404*a* becomes greater than the distance H_Lo during the detection time measurement operation. Hence, since the distance H_Hi will be greater than the distance H_Lo, $$H_\mathrm{Hi}>H_\mathrm{GAP} \tag{12}$$

will naturally be satisfied as long as equation (11) is satisfied. In addition, since the difference between the distance H_Hi and the distance H_GAP will be greater than that between the distance H_Lo and the distance H_GAP in a case in which both equations (11) and (12) are satisfied, the ratio of the diffused light 1405 that will directly enter the center portion of the orifice surface 201*a* in the Y direction will decrease more than in the case of the distance H_Lo. Hence, the generation of a detection time error can be reduced.

As described with reference to FIGS. 14A to 15B, according to this arrangement example, it is possible to use the housing 2051 and the opening 1401 thereof to suppress the light receiving element 402 from receiving light that has been emitted from the light emitting element 401 and has been reflected by the orifice surface 201*a*. Hence, it will be possible to reduce an error that occurs, due to the diffused light 1405 hitting the orifice surface 201*a*, in the measurement of an ink droplet which is discharged from an orifice positioned at the center position of the orifice surface 201*a* in the Y direction.

Note that this arrangement example described an example in which a part of the light emitted from the light emitting element 401 is shielded so as to suppress the diffused light 1405 from entering the center position of the orifice surface 201*a* in the Y direction. However, it is also possible to employ an arrangement in which the shapes and the like of the housing 2051 and its opening 1402, formed on the side of the light receiving element 402, are set so as to suppress the light receiving element 402 from receiving the reflected light 1406. For example, it is possible to shield the reflected light 1406 that propagates toward the light receiving element 402 by decreasing the radius of the opening 1402, increasing the distance from the light receiving element 402 to the far-end portion, with respect to the light receiving element 402, of the opening 1402 in the Y direction, and the like.

In addition, this arrangement example showed equation (11) as a condition in which the diffused light 1405 will not enter the center position of the orifice surface 201*a* in the Y direction. However, it may be arranged so the diffused light 1405 will not enter the orifice surface 201*a* over the entire region of the orifice surface 201*a* in the Y direction. More specifically, by using a width LN of the orifice surface 201*a* in the Y direction, the shape and the dimension of each portion may be set so as to satisfy $$H_\mathrm{Lo}>da\times\{(La+L_\mathrm{MID}+LN/2)/La\} \tag{13}$$

As a result, the generation of a detection time error can be reduced more effectively.

(Arrangement Example 2 (FIG. 16A to FIG. 17))

According to Arrangement Example 1, as a method of suppressing the light emitted from the light emitting element 401 from entering the center position of the orifice surface 201*a* in the Y direction, the distance H_Lo, the radius da of the opening, and the distance La may be set to satisfy a state in which distance H_Lo>distance H_GAP.

On the other hand, since this embodiment has an arrangement in which the printhead 201 operates in the height direction and the scanning directions, due to the shape of the droplet detecting unit 205, there may be restrictions on the positional relationship between the printhead 201 and the droplet detecting unit 205, and the like. For example, if the distance La from the light emitting element 401 to the far end of the opening 1401 is increased, there is a concern that this will interfere with the operation region of the printhead 201. In addition, to facilitate the optical design of the sensor and to ensure a necessary light amount while using a low-cost arrangement, the droplet detecting unit 205 may need to be arranged as close to the light emitting element 401 and the light receiving element 402 as possible. Furthermore, to satisfy the ink droplet detection performance, the distance between the printhead 201 and the droplet detecting unit 205 may need to be brought particularly closer in the height direction (Z) or the longitudinal direction (Y), or the radius da of the opening 1401 may need to be increased. However, it may be difficult to simultaneously satisfy both these restrictions and the condition of equation (11) in some cases. Hence, in Arrangement Example 2, the diffused light 1405 will be suppressed from entering the orifice surface 201*a* by arranging a light shielding portion 1501 (to be described later) in the droplet detecting unit 205.

Figure 16A:
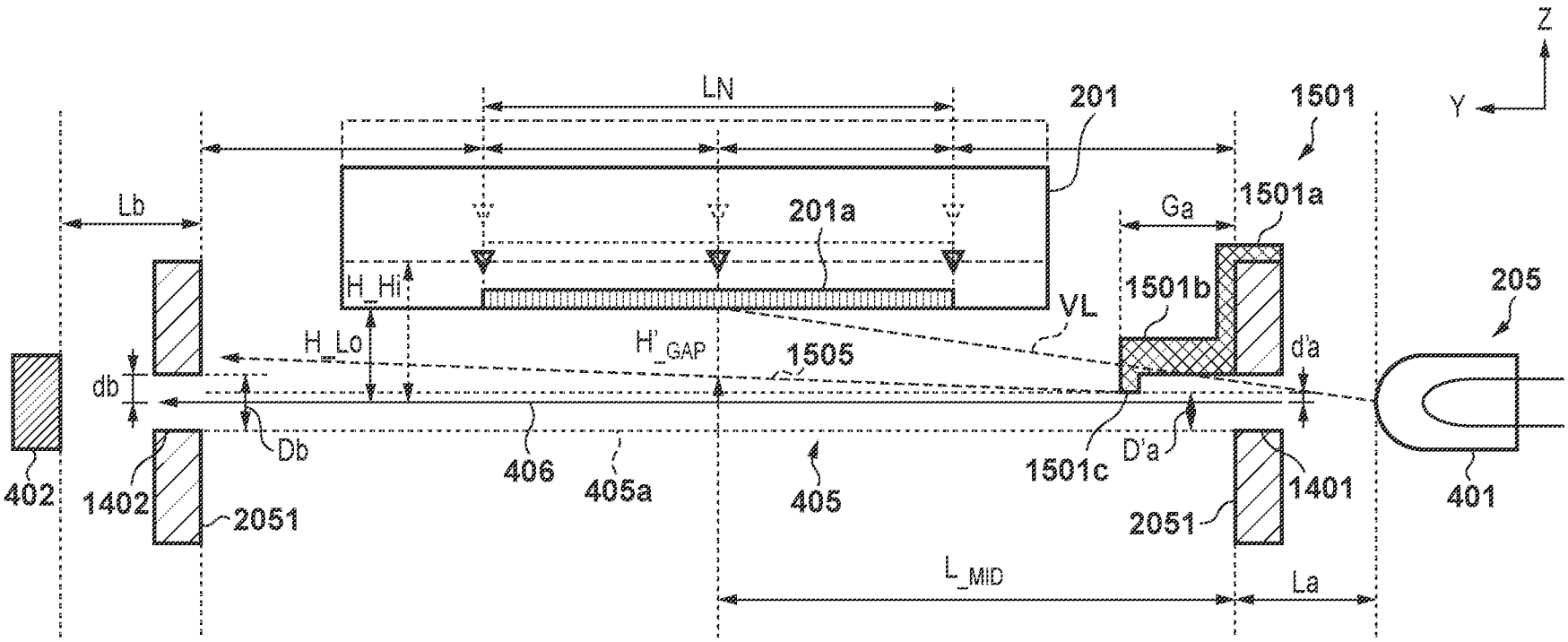
FIG. 16A is a schematic view showing the section of the printhead and the droplet detection unit obtained when the printing apparatus is cut along the section Y-Z.

FIG. 16A is a schematic view of the printhead 201 and the droplet detecting unit 205 be obtained when the printing apparatus 100 is cut along a section Y-Z, and shows an additional arrangement example of the droplet detecting unit 205 and its periphery. FIG. 16A shows a case in which a light beam 405 is formed by adding, in addition to the opening 1401 arranged near the light emitting element 401, the light shielding portion 1501 for shielding diffused light. In addition, the distance between the orifice surface 201*a* of the printhead 201 and the optical axis 406 has been set to the distance H_Lo.

The light shielding portion 1501 is arranged between the opening 1401 and the orifice surface 201*a* to shield at least some of the rays of light that propagate toward the orifice surface 201*a*. In this arrangement example, the light shielding portion 1501 is fixed to a position, of the housing 2051, which is near the opening 1401. The light shielding portion 1501 includes a fixing portion 1501*a*, an extending portion 1501*b*, and a hangover portion 1501*c*. The light shielding portion may be made of the same material as the housing 2051 or be made of a different material.

The fixing portion 1501*a* is a portion that fixes the light shielding portion 1501, separately prepared from the housing, to the housing 2051, and is fixed to the housing 2051 by, for example, a known arrangement such as an adhesive, a screw, or the like. The extending portion 1501*b* is arranged to extend from the fixing portion 1501*a* to the side of the printhead 201 in the Y direction. The hangover portion 1501*c* is arranged in an end, of the extending portion 1501*b*, opposite to the side of the fixing portion 1501*a*, so as to protrude downward from the extending portion 1501*b*.

In this arrangement example, the light beam 405 is formed as follows. That is, a light beam is formed when a part of light emitted from the light emitting element 401 passes the opening 1401. The light beam 405 is formed by the light shielding portion 1501 shielding, among the rays of the light beam formed by the opening 1401, at least some of the rays of light that propagate toward the orifice surface 201*a*. That is, in this arrangement example, the light beam 405 is formed when the light shielding portion 1501 shields some of the rays of light included in the light beam formed by the opening 1401. In addition, of the light included in the light beam 405 formed in such a manner, diffused light 1505 on the upper side of the light beam 405 in the vertical direction will propagate in a straight line to the side of the orifice surface 201*a*.

In this arrangement example, the distance between the printhead 201 and the light beam 405 is set to H_Lo. On the other hand, a distance, in the Z direction, between the diffused light 1505 and the optical axis 406 at a position identical to the center position of the orifice surface 201*a* in the Y direction is indicated as a distance H' GAP. In other words, the distance H' GAP is a Z value of the diffused light 1505 when Y=La+L_MID in a case in which the light emission position of the light emitting element 401 is the origin.

At this time, the distance H'_GAP can be obtained based on the relation between the ratios of the distance La, the distance L_MID, a distance Ga, and a radius d'a of the opening 1401 from the center of the light beam. That is, $$H'_\mathrm{GAP}:d'a=(La+L_\mathrm{MID}):(La+Ga) \tag{14}$$

Hence, $$H'_\mathrm{GAP}=d'a\times\{(La+L_\mathrm{MID})/(La+Ga)\} \tag{15}$$

Here, the distance Ga is a distance from the far end of the opening 1401 to the end of the light shielding portion 1501 in the +Y direction.

Hence, in a manner similar to FIG. 14A, when $$H_\mathrm{Lo}>H'_\mathrm{GAP} \tag{16}$$

is established, the light shielding portion 1501 can effectively shield the diffused light 1505 that enters the center position of the orifice surface 201*a* in the Y direction. Thus, it will be possible to reduce the influence of an error in the measurement of the detection time which is the time it takes for a discharged ink droplet to reach the light beam 405. In addition, even in a case in which the distance between the printhead 201 and the light beam 405 is set to the height of H_Hi which is greater than H_Lo, the light shielding portion 1501 joined to the opening 1401 will be able to effectively shield the diffused light 1505 that can enter the orifice surface 201*a*.

As described above, according to this arrangement example, emitted light is partially shielded by the opening 1401 arranged near the light emitting element, and the light beam 405 is formed by further using the light shielding portion 1501, which is joined to the opening 1401, to shield the light which passed through the opening 1401. This will decrease the distance H'_GAP of the diffused light 1505 and suppress the diffused light 1505 from entering the orifice surface 201*a*. As a result, it will be possible to reduce an error when the time it takes for an ink droplet that has been discharged from the printhead 201 to reach the light beam 405 is measured. Furthermore, it will be possible to form, while avoiding interference with the operation range of the printhead 201 in the height direction and the scanning directions, the light shielding portion 1501 for effectively shielding the light emitted from the light emitting element 401.

Also, as described above, from a certain aspect, the opening 1401 functions as a formation unit that forms a light beam. The light shielding portion 1501 also functions as a light shielding unit that is arranged between the opening 1401 as the formation unit and the orifice surface 201*a* to shield some of the rays of light, among the rays of light formed by the opening 1401, which propagate to the orifice surface 201*a*. Hence, the opening 1401 and the light shielding portion 1501 function as a suppression unit that suppresses the light receiving element 402 from receiving the light which has been emitted from the light emitting element 401 and has been reflected by the orifice surface 201*a*.

In addition, in this arrangement, the extending portion 1501*b* and the hangover portion 1501*c* as portions that do not overlap the printhead 201 in the Z direction are arranged extending in the Y direction in light shielding portion 1501. Hence, the light shielding portion 1501 can shield, while avoiding interference with the printhead 201, the light that propagates to the orifice surface 201*a*.

Note that in this arrangement example, the light shielding portion 1501 and the opening 1401 are separate components, and the light shielding portion 1501 is fixed to the opening 1401. The necessary size of the suppression changes depending on the distance to the orifice surface 201*a* and the distance between the light emitting element 401 and the light receiving element 402. By setting an arrangement in which the light shielding portion 1501 is attached to the opening 1401, only the light shielding portion 1501 will be the component whose arrangement needs to be changed if the apparatus arrangement is to be changed, and the same arrangement can be used for the housing 2051.

On the other hand, the light shielding portion 1501 may be formed as a part of the housing 2051. This will reduce the number of components and the number of assembly processes.

Note that the light shielding portion 1501 may not be arranged in the droplet detecting unit 205, but may be supported and arranged in, for example, another portion in the printing apparatus 100. However, it is preferable for the relative positional relationship between the light shielding portion 1501 and the light shielding portion 1501 to be defined by fixing the light shielding portion 1501 to the housing 2051 which is provided with the opening 1401 as in FIG. 16 or by integrally forming the light shielding portion 1501 with the housing 2051. This will reduce the influence of assembly errors and the like, and allow the light shielding portion 1501 to be aligned easily.

In addition, by fixing the light shielding portion 1501 to the housing 2051 or by integrally forming the light shielding portion 1501 with the housing 2051, the amount of the light beam 404 that can be shielded by the light shielding portion 1501 can be kept constant. Hence, it will be possible to stabilize the detection accuracy even when the height of the printhead 201 is brought closer to or separated from the light beam 404 during the measurement of the ink droplet discharge speed.

In addition, according to this arrangement example, by installing the light shielding portion 1501 immediately after or near the opening 1401 in the direction of propagation of the light beam 405, it will be possible to ensure the light shielding performance of the light shielding portion 1501 while minimizing its size. Since this will allow the droplet detecting unit 205 to be brought closer to the printhead 201, the distance between the light emitting element 401 and the light receiving element 402 can be shortened, and the distance of the droplet detecting unit 205 in the Y direction can be shortened. Hence, the performances of the light emitting element 401 and the light receiving element 402 can be ensured by a low-cost arrangement. Furthermore, it will be possible to maintain the necessary light amount without increasing the distance from the light emitting element to the light receiving element, and to optimize the shape of the light shielding portion.

Note that when the relation shown in equation (16) is viewed from another point of view, the light shielding portion 1501 suffices to be arranged to shield a virtual line VL that connects the light emitting element 401 and the center position of the orifice surface 201*a* in the Y direction. Also, in order to further improve the light shielding performance of the light shielding portion 1501, the light shielding portion 1501 may be arranged to shield a virtual line (not shown) that connects the light emitting element 401 and the far-end portion, with respect to the light emitting element, of the orifice surface 201*a*.

Figure 17:
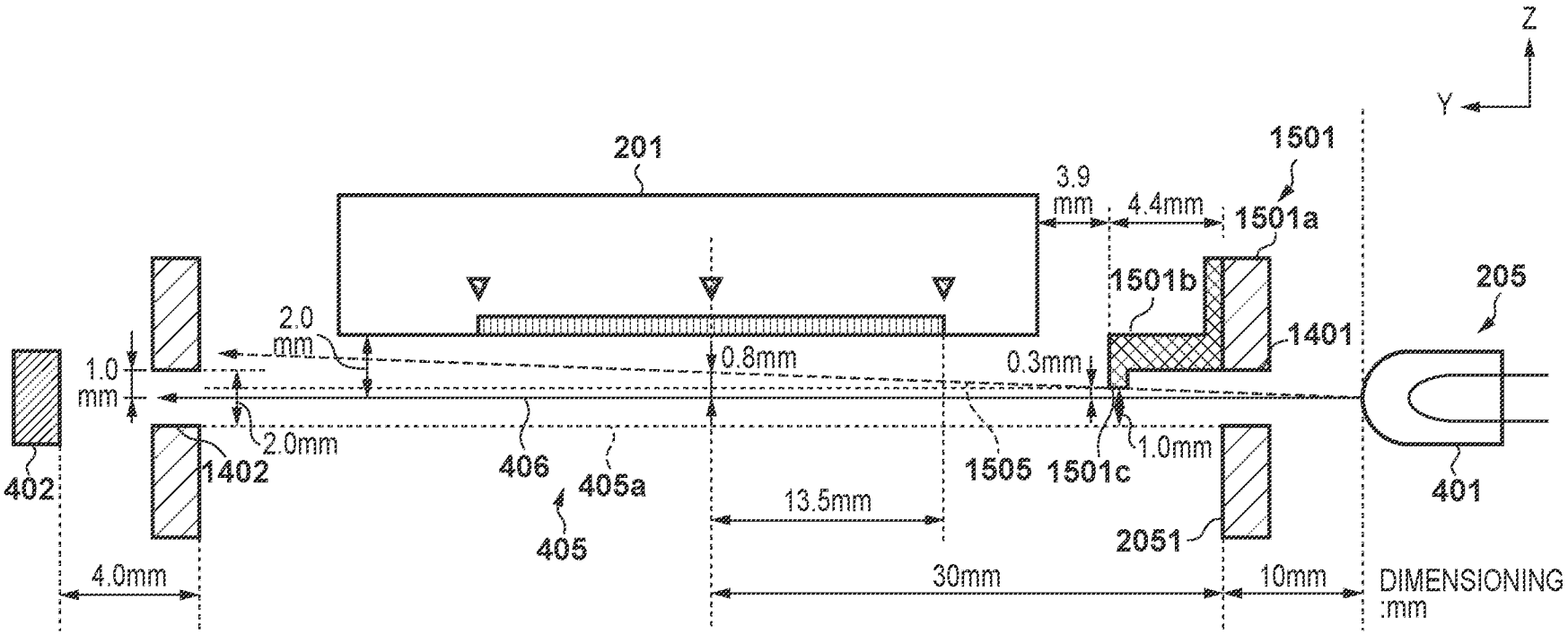
FIG. 17 is a view showing a more specific numerical example of the arrangement shown in FIG. 16A.

FIG. 17 is a view showing a more specific numerical example of the arrangement example shown in FIG. 16A. The numerical example indicates more effective dimensions and shapes based on an experiment by the present inventor. Note that the numerical example indicated below is merely an example, and the embodiment is not limited to the arrangement shown by the numerical example.

In this numerical example, the distance, in the height direction (Z direction), between the orifice surface 201*a* of the printhead 201 and the light 404 emitted by the light emitting element 401 is set to H_Lo=2.0 mm. Also, in this numerical example, the light emitting element 401 is a φ5 light-emitting LED, the light receiving element 402 which includes a light receiving unit of 3 mm, and the opening 1401 which shields a part of the light 404 emitted from the light emitting element 401 is formed to have a width of 2 mm, and the light beam 405 is formed by partially shielding light from these elements. Also, the opening 1402 further shields some of the rays of the light beam 405 and guides the remaining rays of light to the light receiving element 402. In addition, the droplet detecting unit 205 is formed by setting the distance from the light emitting element 401 to the far-end portion, with respect to the light emitting element 401, of the opening 1401 to approximately 10 mm and the distance from the light emitting element 401 to the light receiving element 402 to approximately 70 mm.

In addition, in this numerical example, the distance from the center position of the orifice surface 201*a*, provided in the printhead 201, to the end of the orifice surface 201*a* in the Y direction is approximately 13.5 mm. Also, in this numerical example, the light shielding portion 1501 is arranged so that the distance d'a between the leading edge of the hangover portion 1501*c* and the optical axis 406 will be 0.3 mm. The light shielding portion 1501 forms the light beam 405 by using the extending portion 1501*b* and the hangover portion 1501*c* to shield some of the rays of light emitted by the light emitting element 401. Hence, the angle of the diffused light 1505, which propagates to a side higher than (the +side of the Z direction) the optical axis 406, with respect to the optical axis 406 can be decreased.

When the arrangement shown by this numerical example is checked against the relations indicated by equations (14), (15), and the like, the distance H'_GAP, at the center position of the orifice surface 201*a* in the Y direction, of the diffused light 1505 that entered from the light beam 405 is approximately 0.8 mm. Hence, since the distance H'_GAP will be sufficiently smaller than the distance H_Lo, it will be possible to suppress the diffused light 1505 from entering the center position of the orifice surface 201*a*. Therefore, the detection time error due to the droplet detecting unit 205 can be reduced. At this time, the relation between the distance La+Ga and the distance L_MID+La is (La+Ga):(L_MID+La)=(10+4.4):(30+10)=1:2.7.

The numerical example described above is an example of a case in which the diffused light 1505 is suppressed from entering the center position of the orifice surface 201*a*. However, the dimensions and the shapes of the components are not limited to this example. Increasing the distance La+Ga can further minimize the angle of the diffused light 1505 with respect to the optical axis 406. However, since increasing the distance La+Ga will increase the distance between the light emitting element 401 and the light receiving element 402, the received light amount will decrease. Thus, it is preferable for the distance La+Ga to be smaller than ½ of the distance L_MID+La. Here, the distance La+Ga is a Y-directional component of the distance from the light emitting element 401 to the far-end portion, with respect to the light emitting element 401, of the light shielding portion 1501 in the Y direction. The distance L_MID+La is a Y-directional component of the distance from the light emitting element 401 to the center position of the orifice surface 201*a* in the Y direction.

Figure 16B:
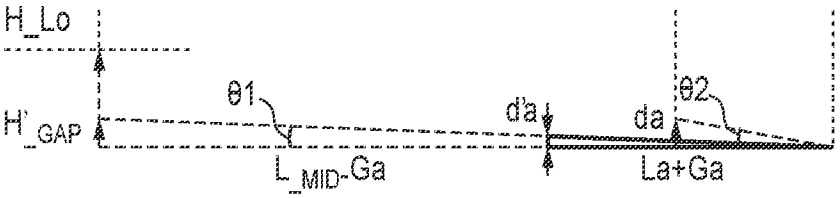
FIG. 16B is a view showing the positional relationship between the printhead and the light emitted by a light emitting element of FIG. 16A.

In addition, the angle, formed by the diffused light 1505 and the optical axis 406, which allows the detection time error of the droplet detecting unit 205 to be effectively reduced has been discovered by the experiment by the present inventor. As shown in FIG. 16B, letting θ1 be an angle formed by the optical axis 406 and the diffused light 1505, which is a ray of light that propagates closest to the orifice surface 201*a* among the rays of light included in the light beam 405, and 02 be an angle formed by the optical axis 406 and the virtual line which connects the light emitting element 401 to the center position of the orifice surface 201*a* in the Y direction, $$\tan \theta 1 = d'a/(Ga+La) \quad (17)$$

$$\tan \theta 2 = H_Lo/(L_MID+La) \quad (18)$$

In the numerical example of FIG. 17, the angle θ1 is approximately 1.2° and the angle θ2 is approximately 2.8°. According to the experiment by the present inventor, in the case of the positional relationship between the light emitting element 401 and the printhead 201 shown in FIG. 17, the detection time error due to the droplet detecting unit 205 can be effectively reduced when the angle θ1 is 1.2° to 1.4°. That is, in this arrangement example, the detection time error due to the droplet detecting unit 205 can be more effectively reduced when the numerical value of the angle θ1 is equal to or less than half of the numerical value of the angle θ2.

Examples of the dimensions and shapes of the respective components when the angle θ1 is 1.2° to 1.4° will be described. For example, if the distance d'a from the optical axis 406 to the hangover portion 1501*c* in the numerical example of FIG. 17 is changed to d'a=0.35 mm, the angle θ1 will be approximately 1.4°. In addition, for example, if the distance Ga in the numerical example of FIG. 17 is changed to Ga=2.1 mm, the angle θ1 will be approximately 1.4°. The detection time error due to the droplet detecting unit 205 can be effectively reduced even when such dimensions and shapes are used.

Note that the numerical value of the above-described angle θ1 is merely an example, and the angle of θ1 is not limited to this. The angle θ1 suffices to be less than the angle θ2. Such an arrangement will allow the light shielding portion 1501 to shield a predetermined amount of light that propagates toward the center position of the orifice surface 201*a* in the Y direction.

In addition, the angle θ1 may be less than an angle formed by the optical axis 406 and a line that connects the light emitting element 401 and the far-end portion, with respect to the light emitting element 401, of the orifice surface 201*a*. Even in such a case, it will be possible to effectively shield the light that propagates to the orifice surface 201*a*. By arranging so as to form such an angle, it will be possible to more accurately detect ink droplets which are discharged from all of the orifices including an orifice arranged at a far position, with respect to the light emitting element 401, of the orifice surface 201*a*.

In addition, although the above embodiments described a condition for improving the detection accuracy of an ink droplet discharged from an orifice positioned at the center of an orifice array, the components may be arranged under another condition if an end of the orifice array is to be detected. For example, when detecting an ink droplet which is discharged from an orifice arranged at a close position, with respect to the light emitting element 401, of the orifice surface 201*a*, the angle θ1 can be arranged to be less than an angle formed by the optical axis 406 and a line that connects the light emitting element 401 to the orifice arranged at the close position, with respect to the light emitting element 401, of the orifice surface 201*a*.

(Arrangement Example 3 (FIG. 18))

Figure 18:
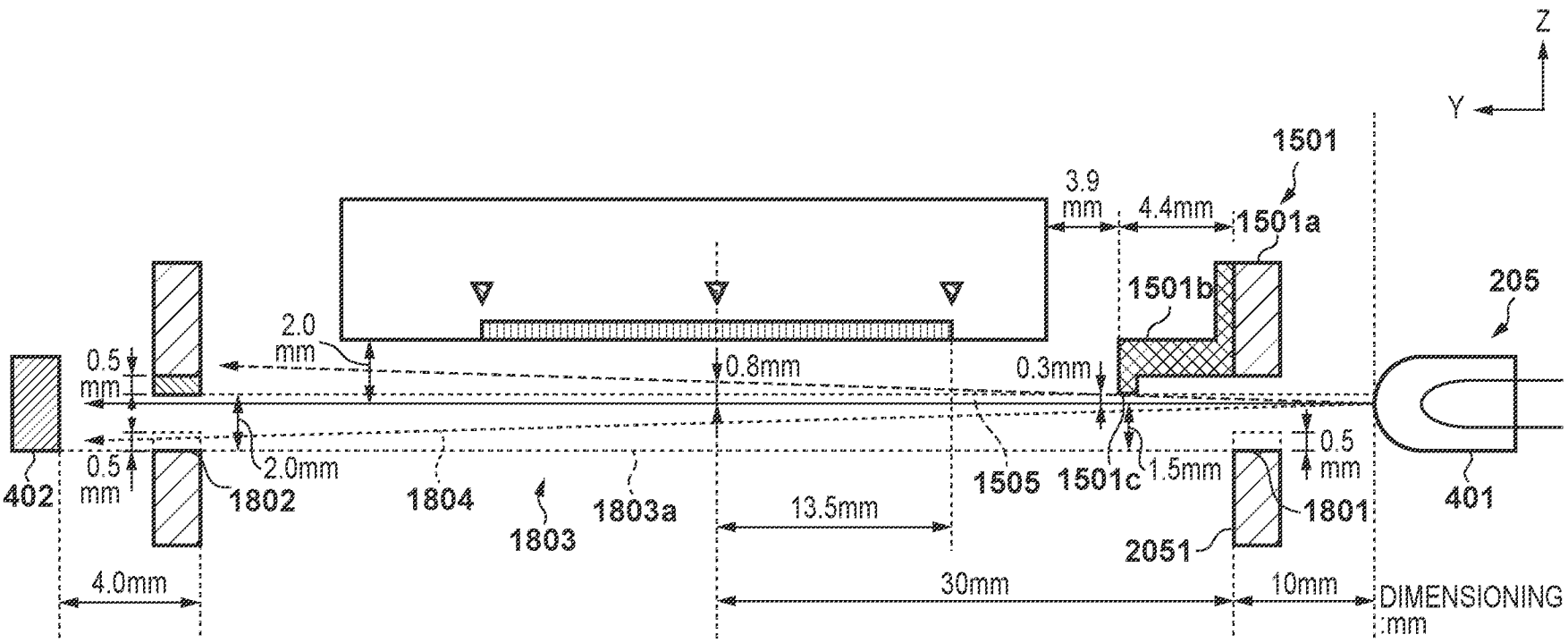
FIG. 18 is a view showing an example of an arrangement with more detailed dimensions and shapes in a case in which a light shielding unit is arranged.

FIG. 18 is a view showing a further arrangement example of the dimensions and the shapes, based on the experiment of the inventor, in a case in which the light shielding portion 1501 for shielding diffused light is arranged in addition to the opening 1401 arranged near the light emitting element 401.

In contrast to the example shown in FIG. 17, FIG. 18 shows a case in which the positions and the shapes of the openings formed in the housing 2051 of the droplet detecting unit 205 are changed. More specifically, an opening 1801, which is arranged near the light emitting element 401, is formed so that the distance to its lower end portion from the optical axis 406 will be longer by 0.5 mm than the case shown in FIG. 17. Hence, the light emitted from the light emitting element 401 will be partially shielded by the opening 1801 and the light shielding portion 1501, and a light beam 1803 which has a width of 1.8 mm will be formed.

In a similar manner, an opening 1802, which is arranged near the light receiving element 402, is formed so that the distance to its lower end portion from the optical axis 406 will be longer by 0.5 mm than the case shown in FIG. 17. In addition, the opening 1802 is formed so that the distance to its upper end portion from the optical axis 406 will be shorter by 0.5 mm than the case shown in FIG. 17. That is, the opening 1802 shown in FIG. 18 is arranged in position offset to the lower side by 0.5 mm than the opening 1402 shown in FIG. 17.

According to this arrangement, the light beam 1803 which has a width of 2 mm can pass through the opening 1802 in a manner unchanged from FIG. 17. In addition, since the position of the opening 1802 has been offset to the lower side in correspondence with the shape of the hangover portion 1501*c* of the light shielding portion 1501 in FIG. 18, the width of the light beam 1803 that directly enters from the light emitting element 401 to the light receiving element 402 has increased by approximately 0.5 mm. Hence, it will be possible to suppress, while effectively ensuring the received light amount of the light receiving element 402, the light reflected by the orifice surface 201*a* from entering the light receiving element.

Furthermore, irregularly reflected light that cannot be shielded by the hangover portion 1501*c* may sometimes be generated depending on the degree of the diffusion of the light emitted from an LED used as the light emitting element 401 or depending on the member of the opening 1801. This irregularly reflected light will influence the detection if it enters the light receiving element 402 upon being reflected by the orifice surface 201*a*. By shortening the distance from the optical axis 406 to the upper end portion of the opening 1802 by 0.5 mm less than the case shown in FIG. 17, the amount of such incident light can be reduced.

According to this arrangement example, even in a case in which the opening 1801 and the light shielding portion 1501 are arranged in consideration to the measurement accuracy of the ink droplet discharge speed, the opening 1802 can be enlarged in the lower side of the optical axis of the light beam to supplement the reduction in the amount of light received by the light receiving element 402.

Note that the specification method of the ink droplet discharge speed of the printhead 201 based on the detection results of the droplet detecting unit 205 to be used in a case in which each arrangement example described in (Arrangement Examples of Periphery of Droplet Detection Unit) is to be applied is not limited to the methods described above in the first to third embodiments. For example, the discharge speed may be calculated by dividing the distance (height) between the orifice surface 201*a* and the print medium 203, which has been detected by the distance detecting sensor 204, by the detection time from the ink droplet discharge by the printhead 201 to the detection of the ink droplet by the droplet detecting unit 205. In addition, for example, a table in which the detection time and the discharge speed has been associated for each height (for example, H1 to H4 of FIGS. 5A to 5D) of the printhead 201 may be stored in the memory 303. Subsequently, the CPU 301 may obtain, based on the height of the printhead 201 and the detection time, the discharge speed from the table stored in the memory 303. That is, the specification of the discharge speed may be performed based on arithmetic processing or by obtaining a table value or the like.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-123149, filed Jul. 17, 2020, which is hereby incorporated by reference herein in its entirety.

What is claimed is:

1. A discharge apparatus comprising:

a discharge head that includes an orifice surface in which orifices each configured to discharge a droplet are arrayed in a predetermined direction;

a detecting unit that includes a light emitting element configured to emit light and a light receiving element configured to receive light emitted from the light emitting element, and configured to optically detect a droplet discharged from the orifice in a state in which the orifice surface of the discharge head is present between the light emitting element and the light receiving element in a predetermined direction; and a suppression unit that is arranged between the light emitting element and the orifice surface, and configured to suppress light emitted from the light emitting element from reaching the orifice surface by shielding at least some rays of light which are emitted from the light emitting element and would otherwise propagate to the orifice surface, wherein the suppression unit includes:

a forming portion configured to form a light beam by shielding some of the rays of light emitted from the light emitting element, and a light shielding portion arranged between the forming portion and the orifice surface so as to shield at least some rays of the light, among rays of light included in the light beam, which would otherwise propagate toward the orifice surface.

2. The apparatus according to claim 1, wherein the suppression unit is arranged to shield at least a ray of light, among rays of light propagating toward the orifice surface, which would otherwise propagate from the light emitting element to a center of the orifice surface in a direction which connects the light emitting element and the light receiving element.

3. The apparatus according to claim 1, wherein the suppression unit is arranged between the light emitting element and the orifice surface so as to shield at least a ray of light, among rays of light propagating toward the orifice surface, which would otherwise propagate from the light emitting element to a center of an orifice array of the orifice surface in a direction which connects the light emitting element and the light receiving element.

4. The apparatus according to claim 1, wherein the suppression unit is arranged between the orifice surface and the light receiving element so as to shield at least some rays of light reflected by the orifice surface and would otherwise propagate toward the light receiving element.

5. The apparatus according to claim 1, wherein the light shielding portion is arranged so that an angle formed by an optical axis of the light beam and a ray of light, among rays of light included in the light beam, which would otherwise propagate closest to the orifice surface will be less than a first angle, and the first angle is an angle formed by the optical axis of the light beam and a line that connects the light emitting element and a center position of the orifice surface in an optical-axis direction.

6. The apparatus according to claim 1, wherein the light shielding portion is arranged so that an angle formed by an optical axis of the light beam and a ray of light, among rays of light included in the light beam, which would otherwise propagate closest to the orifice surface will be less than a second angle, and the second angle is an angle formed by the optical axis of the light beam and a line that connects the light emitting element and a far-end portion, with respect to the light emitting element, of the orifice surface in an optical-axis direction.

7. The apparatus according to claim 1, wherein the light shielding portion is arranged to shield a virtual line that connects the light emitting element and a center position of the orifice surface in an optical-axis direction of the light beam.

8. The apparatus according to claim 1, wherein the light shielding portion is arranged to shield a virtual line that connects the light emitting element and a far-end portion, with respect to the light emitting element, of the orifice surface.

9. The apparatus according to claim 1, wherein the forming portion is a member configured to form an opening which is to be formed in a housing of the detecting unit.

10. The apparatus according to claim 9, wherein the light shielding portion includes a fixing portion fixed to the housing so that at least a part of the light shielding portion will be arranged between the opening and the orifice surface.

11. The apparatus according to claim 1, further comprising a specifying unit configured to specify a discharge speed of the droplet based on a detection result of the detecting unit.

12. The apparatus according to claim 11, wherein the specifying unit is configured to specify the discharge speed based on a time which is a period from when the discharge head discharges a droplet to when the detecting unit detects the droplet discharged from the discharge head, and a distance from the orifice surface to a position where the ink droplet is detected by the detecting unit.

13. A discharge apparatus comprising:

a discharge head that includes an orifice surface in which orifices each configured to discharge a droplet are arrayed in a predetermined direction;

a detecting unit that includes a light emitting element configured to emit light and a light receiving element configured to receive light emitted from the light emitting element, and configured to optically detect a droplet discharged from the orifice in a state in which the orifice surface of the discharge head is present between the light emitting element and the light receiving element in a predetermined direction; and a suppression unit that is arranged between the light emitting element and the orifice surface, and configured to suppress light emitted from the light emitting element from reaching the orifice surface by shielding at least some rays of light which are emitted from the light emitting element and would otherwise propagate to the orifice surface, wherein the suppression unit includes:

a forming portion configured to form a light beam by shielding some of rays of light emitted from the light emitting element, and a light shielding portion arranged between the forming portion and the orifice surface so as to shield at least some rays of the light, among rays of light included in the light beam, which would otherwise propagate toward the orifice surface, and wherein in the light shielding portion, an optical-axis direction component of a distance from the light emitting element to an end, of the light shielding portion, on a far side from the light emitting element in an optical-axis direction of the light beam is smaller than ½ of an optical-axis direction component of a distance from the light emitting element to a center position of the orifice surface in the optical axis direction.

* * * * *